US008256064B2

(12) United States Patent
Blersch et al.

(10) Patent No.: US 8,256,064 B2
(45) Date of Patent: Sep. 4, 2012

(54) REFRIGERATOR AND/OR FREEZER WITH HINGE

(75) Inventors: Dietmar Blersch, Ertingen (DE); Oliver Weidelener, Alleshausen (DE)

(73) Assignee: Liebherr-Hausgeraete Ochsenhausen GmbH, Ochsenhausen (DE)

( * ) Notice: Subject to any disclaimer, the term of this patent is extended or adjusted under 35 U.S.C. 154(b) by 278 days.

(21) Appl. No.: 12/527,553

(22) PCT Filed: Feb. 19, 2008

(86) PCT No.: PCT/EP2008/001282
§ 371 (c)(1),
(2), (4) Date: Aug. 17, 2009

(87) PCT Pub. No.: WO2008/101666
PCT Pub. Date: Aug. 28, 2008

(65) Prior Publication Data

US 2010/0109497 A1 May 6, 2010

(30) Foreign Application Priority Data

Feb. 19, 2007 (DE) ..... 20 2007 002 453 U
Apr. 25, 2007 (DE) ..... 20 2007 005 957 U

(51) Int. Cl.
*E05F 1/08* (2006.01)

(52) U.S. Cl. ..... 16/286; 16/366; 16/54

(58) Field of Classification Search ..... 312/322, 312/323, 325, 319.1, 319.2, 319.6, 319.7; 16/286–292, 280–283, 366, 370, 306–308; 49/254, 255, 260, 246, 371; 292/70, 75, 292/73, 76, 77, 79, 262, 267
See application file for complete search history.

(56) References Cited

U.S. PATENT DOCUMENTS 1,898,609 A * 2/1933 Anderson ..... 16/61
3,204,287 A * 9/1965 Gronbach ..... 16/288
3,548,444 A 12/1970 Jacobus et al.
4,341,083 A 7/1982 Ibrahim et al.
4,658,473 A 4/1987 Schema (Continued)

FOREIGN PATENT DOCUMENTS

DE 7929527 4/1981

(Continued)

OTHER PUBLICATIONS

German Patent and Trademark Office, Search Report of 20 2007 005 957.4, Nov. 6, 2008, Germany, 4 pages.

(Continued)

*Primary Examiner* — Chuck Y. Mah
(74) *Attorney, Agent, or Firm* — Alleman Hall McCoy Russell & Tuttle LLP

(57) ABSTRACT

The present invention relates to a refrigerator and/or freezer with a door or flap for closing the appliance interior, with a hinge, by means of which the door or flap can be swivelled relative to the body of the appliance, wherein the hinge includes means for producing a closing force acting in closing direction of the door or flap, and with a damper which at least over a part of the closing movement of the door or flap applies a force directed against the closing movement of the door or flap, wherein the means for producing a closing force include an eccentric and means which exert a force that acts on the eccentric and is dependent on the opening angle of the door or flap.

26 Claims, 34 Drawing Sheets

U.S. PATENT DOCUMENTS

| | | | | |
|---|---|---|---|---|
| 4,924,626 | A * | 5/1990 | Ts'ao | 49/347 |
| 5,075,923 | A * | 12/1991 | Taylor | 16/63 |
| 5,220,747 | A * | 6/1993 | Cherry et al. | 49/386 |
| 5,522,656 | A | 6/1996 | Jenkins | |
| 5,722,114 | A * | 3/1998 | Lapp et al. | 16/78 |
| 5,758,937 | A * | 6/1998 | Lammens et al. | 312/328 |
| 5,896,619 | A | 4/1999 | Koopman | |
| 6,505,381 | B1 * | 1/2003 | Thomson et al. | 16/302 |
| 6,684,453 | B2 * | 2/2004 | Wang | 16/54 |
| 6,845,545 | B2 | 1/2005 | Han et al. | |
| 7,096,535 | B2 * | 8/2006 | Lin | 16/287 |
| 7,178,202 | B2 * | 2/2007 | Hirtsiefer et al. | 16/366 |
| 7,406,749 | B2 * | 8/2008 | Herper | 16/368 |
| 7,500,287 | B2 * | 3/2009 | Brustle | 16/286 |
| 7,886,407 | B2 * | 2/2011 | Resnik et al. | 16/286 |
| 7,976,079 | B2 * | 7/2011 | Hirtsiefer | 292/262 |
| 2001/0020811 | A1 * | 9/2001 | Kawanabe | 312/319.2 |
| 2001/0039762 | A1 * | 11/2001 | Giovannetti | 49/246 |
| 2002/0108311 | A1 * | 8/2002 | Salice | 49/371 |
| 2005/0206286 | A1 | 9/2005 | Finkelstein | |
| 2008/0121490 | A1 * | 5/2008 | Dubach et al. | 192/17 D |
| 2008/0168618 | A1 * | 7/2008 | Hottmann | 16/50 |

FOREIGN PATENT DOCUMENTS

| | | |
|---|---|---|
| DE | 29611392 | 10/1996 |
| DE | 19828333 | 12/1999 |
| DE | 20306043 | 8/2004 |
| DE | 202004017712 | 3/2006 |
| DE | 202004020900 | 11/2006 |
| DE | 102006019332 | 12/2006 |
| DE | 202006010482 | 12/2007 |
| EP | 1055881 | 11/2000 |
| EP | 1703053 | 9/2006 |
| GB | 1121380 | 7/1968 |
| KR | 100142056 | 3/1998 |
| WO | 2006006707 | 1/2006 |
| WO | 2006069882 | 7/2006 |
| WO | 2007/009783 | 1/2007 |

OTHER PUBLICATIONS

ISA Germany, International Search Report of PCT/EP2008/001282, Feb. 19, 2008, WIPO, 8 pages.

* cited by examiner

REFRIGERATOR AND/OR FREEZER WITH HINGE

CROSS REFERENCE TO RELATED APPLICATION

This is the U.S. National Phase of International PCT Application Serial No. PCT/EP2008/001282, filed Feb. 19, 2008, which claims priority to German Utility Model Application No. 20 2007 002 453.3, filed Feb. 19, 2007, and German Utility Model Application No. 20 2007 005 957.4 filed Apr. 25, 2007, all of which are hereby incorporated by reference in their entirety for all purposes.

TECHNICAL FIELD

The present invention relates to a refrigerator and/or freezer with a door or flap for closing the appliance interior, with a hinge, by means of which the door or flap can be swivelled relative to the body of the appliance, wherein the hinge includes means for producing a closing force acting in closing direction of the door or flap, and with a damper which at least over a part of the closing movement of the door or flap applies a force directed against the closing movement of the door or flap.

BACKGROUND AND SUMMARY

Such refrigerator and/or freezer is known from the prior art. U.S. Pat. No. 6,845,545 B2 discloses a refrigerator in whose foot region a damper is arranged, which consists of a piston movably accommodated in a cylinder, which is inserted into the cylinder by means of a piston rod, when the door is closed. The cylinder is pivotally arranged on the body of the appliance and extends substantially parallel to the side wall of the appliance. The refrigerator known from U.S. Pat. No. 6,845,545 B2 furthermore includes means for producing a closing force, which are formed by a coil spring which is tensioned when the door is opened and exerts a closing force onto the door or flap over a specified angular range, so that an automatic and damped closing of the door is effected in said angular range.

It is the object of the present invention to improve a refrigerator and/or freezer as mentioned above such that with an opening angle of the door or flap above a specified angle, the door or flap stops in its position determined by the user of the appliance, and that with an opening angle of the door or flap below the specified angle, an automatic closing of the door or flap is effected.

This object is solved by a refrigerator and/or freezer appliance with a door or flap for closing an appliance interior, with a hinge, by means of which the door or flap can be swivelled relative to a body of the appliance. Accordingly, it is provided that the hinge includes means for producing a closing force, wherein the means for producing a closing force includes an eccentric as well as means which produces a force that acts on the eccentric and is dependent on the opening angle of the door or flap. In accordance with the invention, it thus is provided that in dependence on the opening angle a closing force acts on the door or flap, which is due to the fact that a force is exerted on an eccentric of the hinge.

It is conceivable for instance that the eccentric is configured such that above an opening angle of 55° no more forces which cause a closing movement will act on the door or flap. Thus, the door or flap remains in the position into which it was brought by the user. In this way, it is prevented that from a specified opening angle the door automatically moves into the open end position or is closed automatically. Thus, damages to the appliance, which possibly are caused by unintentional opening of the door, are prevented.

The means which produce a force acting on the eccentric can be configured and arranged such that it exerts a compressive force onto the surface of the eccentric. The eccentric can be configured and arranged such that in a first angular range the compressive force produces no torque acting on the eccentric, so that the door or flap stops, and in a second angular range produces a torque acting on the eccentric, which leads to the closing of the door or flap.

The hinge can include a first hinge lever and a second hinge lever, one of which is pivotally connected with the door or flap and the other one is pivotally connected with the body of the appliance, wherein the eccentric and the means which produce a force acting on the eccentric each are pivotally arranged on one of the hinge levers or both on one of the hinge levers.

In a further aspect of the invention it is provided that the hinge includes a first hinge lever and a second hinge lever, one of which is pivotally connected with the door or flap and the other one is pivotally connected with the body of the appliance, and that the hinge furthermore includes a tension lever which is pivotally arranged on the eccentric and on one of the hinge levers, wherein the axis on which the tension lever is pivotally attached to the eccentric does not coincide with the axis of rotation of the eccentric. Via the tension lever, the torque acting on the eccentric is converted into a force which leads to the closing of the door or flap.

In a further aspect of the invention it is provided that the means which produces a force acting on the eccentric include one or more compression springs and a roller or a sliding element which runs on the surface of the eccentric or acts on the same.

In a further aspect of the invention, the means which exerts a force acting on the eccentric are configured as leaf springs, leg springs, spiral springs or coil springs.

In a further aspect of the invention it is provided that the damper includes a piston moving in a cylinder and a piston rod connected with the piston, which is pivotally attached to the hinge. In this aspect of the invention, the piston rod is directly connected with the hinge.

Furthermore, it can be provided that the piston rod is not directly connected with the hinge, but that a damper lever is provided, which is pivotally connected with the piston rod and with the hinge.

The damper can be arranged such that independent of the opening angle of the door or flap it extends approximately parallel to the plane formed by the door or flap or to the plane formed by the front side of the body.

In a further aspect of the invention, one or more rollers are provided, which are arranged on the damper lever and are configured such that at least when the door or flap is closed, they absorb forces acting transverse to the piston rod of the damper. It is conceivable that when the door or flap is closed, the forces acting transverse to the piston rod are absorbed via the rolling friction, and when the door is opened, they are absorbed via one or more sliding elements running in one or more grooves.

Accordingly, it can be provided that one or more sliding elements are directly or indirectly arranged on the damper lever, which are guided in one or more grooves of a carrier. It is possible to provide a configuration both with one or more sliding elements and with one or more rollers. It is likewise conceivable to omit the rollers and absorb transverse forces exclusively via the sliding elements both when opening and when closing the door.

For the purpose of varying the damper stroke, it can be provided that one or more spacers are insertable into the groove, so that the free groove length is varied.

The damper lever can releasably be connected with the piston rod such that it is coupled with the piston rod over a first opening angle of the door or flap and that it is uncoupled from the piston rod over a second opening angle of the door or flap. In this way, shortening of the required damper path can be achieved.

In a further aspect of the invention it is provided that the hinge includes a connecting link guide in which means are guided, which exerts a force acting on the eccentric. By changing the connecting link guide, the closing characteristic of the arrangement can be varied.

The hinge can include a first lever and a second lever, one of which is pivotally connected with the door or flap and the other one is pivotally connected with the body of the appliance, wherein the connecting link guide is arranged in one of the levers.

The means which produces a force acting on the eccentric can be pivotally arranged about a pivot point, whose position can be varied. In this way, it is possible to vary the door closing force or the closing behavior of the door. It is conceivable to form the pivot point by an eccentric bolt.

In a further aspect of the invention it is provided that the damper includes a piston moving in a cylinder and a piston rod connected with the piston and that for the purpose of varying the damping behavior the position of the piston with respect to the damper cylinder is changed. This relative movement can be achieved by changing the pivotal attachment/arrangement of the damper cylinder on a carrier or the like and/or by changing the pivotal attachment of the piston rod.

In a further aspect of the invention, a carrier is provided, in which the damper is arranged, wherein the damper is connected with the carrier for instance by means of a positive connection, preferably by means of a latching connection. In this way, it is achieved that the damper can easily be mounted in the carrier and that the damper can easily be replaced, if necessary.

Particularly preferably, a module is provided, which includes a carrier, in or on which both the damper and the hinge are arranged, wherein the module is inserted into the door or flap or into the body of the appliance as a unit. Such modular construction is particularly advantageous, because the mounting effort is minimal and because a change in the door stop can be performed with very little effort. In principle, such modular construction can also be omitted. However, this involves disadvantages for instance when changing the door stop, since the individual components of the hinge or damper of the invention then must directly be incorporated in the door or in the body.

In a further aspect of the invention it is provided that the hinge and the damper and in particular the module according to claim 20 is arranged outside the cooled region of the appliance. Temperature fluctuations and the disadvantage of a possible formation of condensation water are effectively prevented in this way, and the service life of hinge and damper is prolonged correspondingly.

It is conceivable to arrange the hinge and the damper for instance in a region of the door which lies outside the region surrounded by the door seal. This can be in the lower region or also in the upper region of the door. The same applies to an arrangement of hinge and damper on the body.

The damper and in particular the module can be arranged in the side of the door facing the body or in the side of the body facing the door. The damper and in particular the module can be arranged substantially parallel to the plane formed by the door or substantially parallel to the plane formed by the front side of the body.

The module can be connected with the door or with the body of the appliance by a positive connection, in particular by a latching connecting and/or screw connection. It is conceivable for instance that the module is fixed in the door or in the body in a particularly simple way by positive connection. If necessary, locking can be effected by one or more screws.

The invention furthermore relates to a refrigerator and/or freezer with a door or flap for closing the appliance interior, with a hinge by means of which the door or flap can be swivelled relative to the body of the appliance, wherein the hinge includes means for producing a closing force acting in closing direction of the door or flap, and with a damper which at least over a part of the closing movement of the door or flap applies a force directed against the closing movement of the door or flap, wherein the means for producing a closing force comprise a tension cable which on the one hand is connected with the hinge and on the other hand with one or more tension springs.

The present invention furthermore relates to a refrigerator and/or freezer with a door or flap for closing the appliance interior, with a hinge by means of which the door or flap can be swivelled relative to the body of the appliance, wherein the hinge includes means for producing a closing force acting in closing direction of the door or flap, and with a damper which at least over a part of the closing movement of the door or flap applies a force directed against the closing movement of the door or flap, wherein the means for producing a closing force and the damper are formed by an electric drive.

The invention furthermore relates to a refrigerator and/or freezer with a door or flap for closing the appliance interior, with a hinge by means of which the door or flap can be swivelled relative to the body of the appliance, wherein the hinge includes means for producing a closing force acting in closing direction of the door or flap, and with a damper which at least over a part of the closing movement of the door or flap applies a force directed against the closing movement of the door or flap, wherein a module is provided, which includes a carrier in or on which the damper and the hinge are arranged, wherein the module is inserted into the door or flap or into the body of the appliance as a unit.

Further details and advantages of the invention will be explained in detail with reference to the embodiments illustrated in the drawing, which show a floor-mounted appliance in accordance with the present invention. In the drawings:

DETAILED DESCRIPTION

Figure 1A:
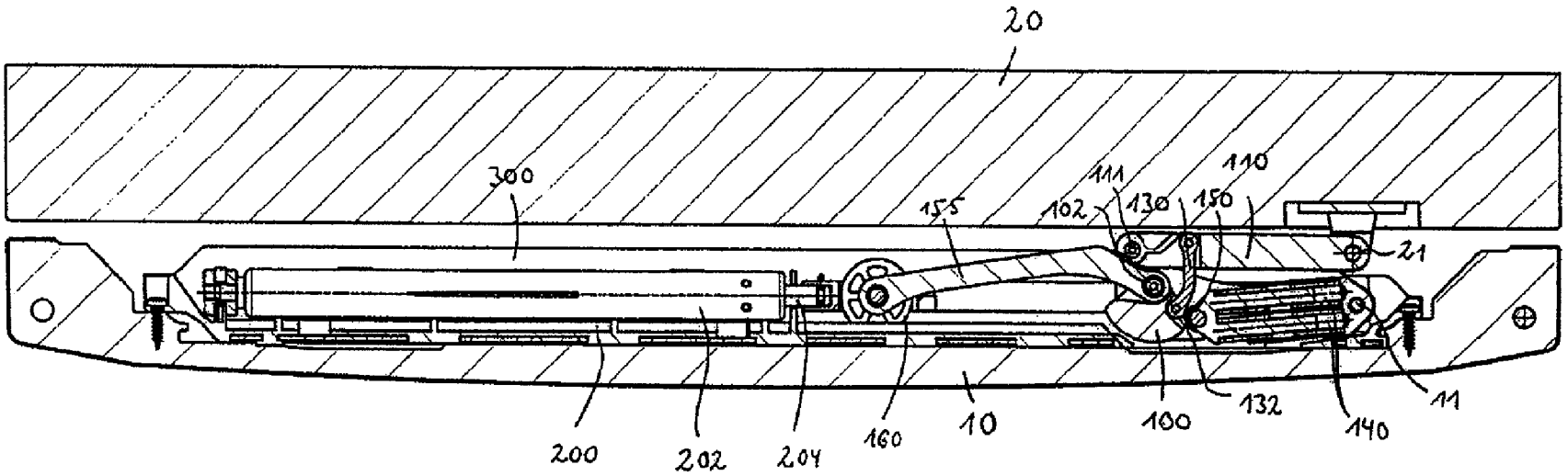
FIG. 1*a* to FIG. 1*j*: show the hinge with damper in accordance with a first embodiment of the invention in a sectional representation with different opening angles.

FIG. 1 shows a sectional representation of the body 20 of a refrigerator and the door 10 by means of which the appliance interior can be closed. Reference numeral 200 designates an oil/gas damper, which consists of a cylinder 202 in which a non-illustrated piston is moving. The piston is connected with a piston rod 204, whose end can be seen in FIG. 1.

Figure 1B:
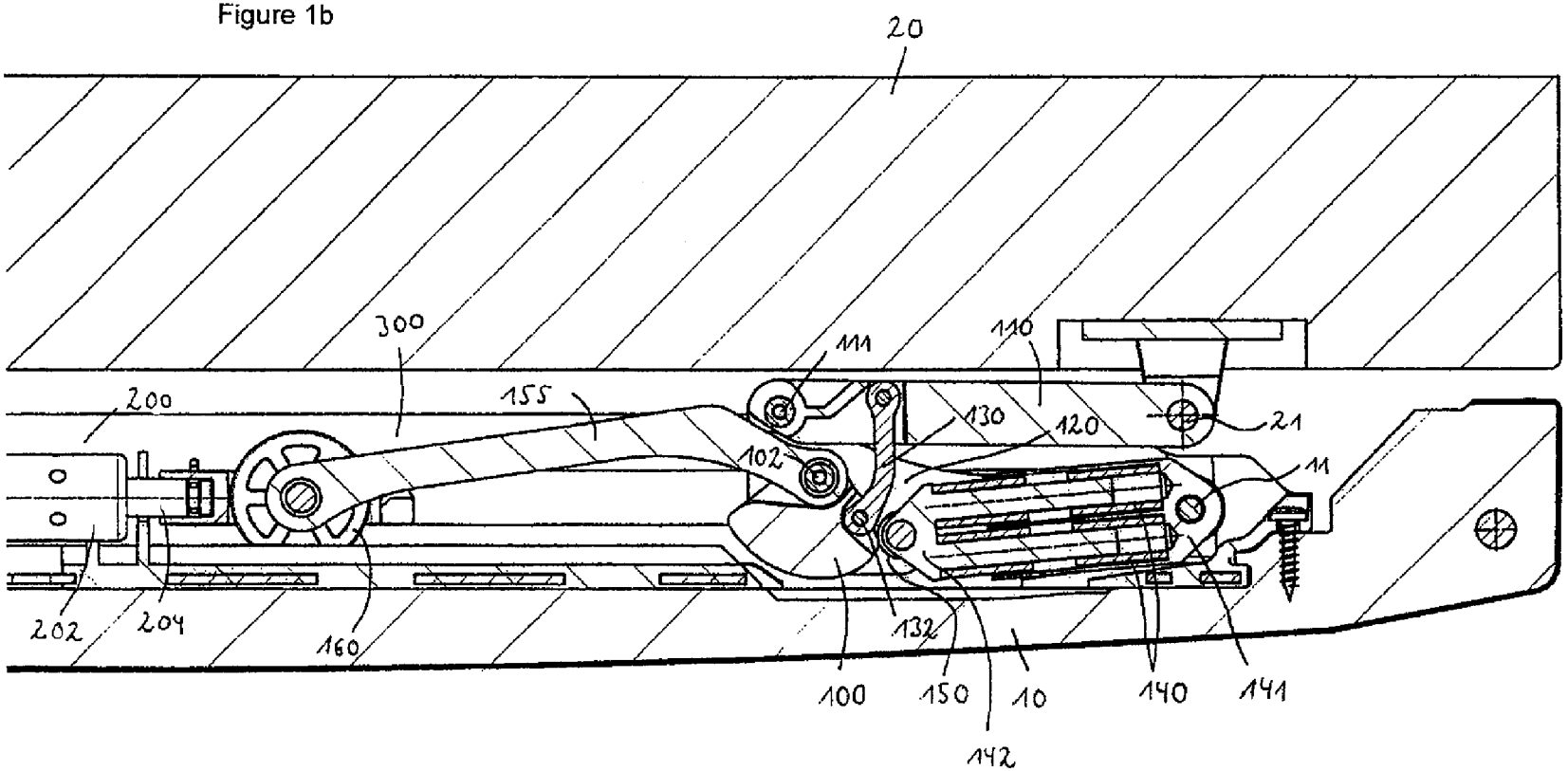
Figure 1C:
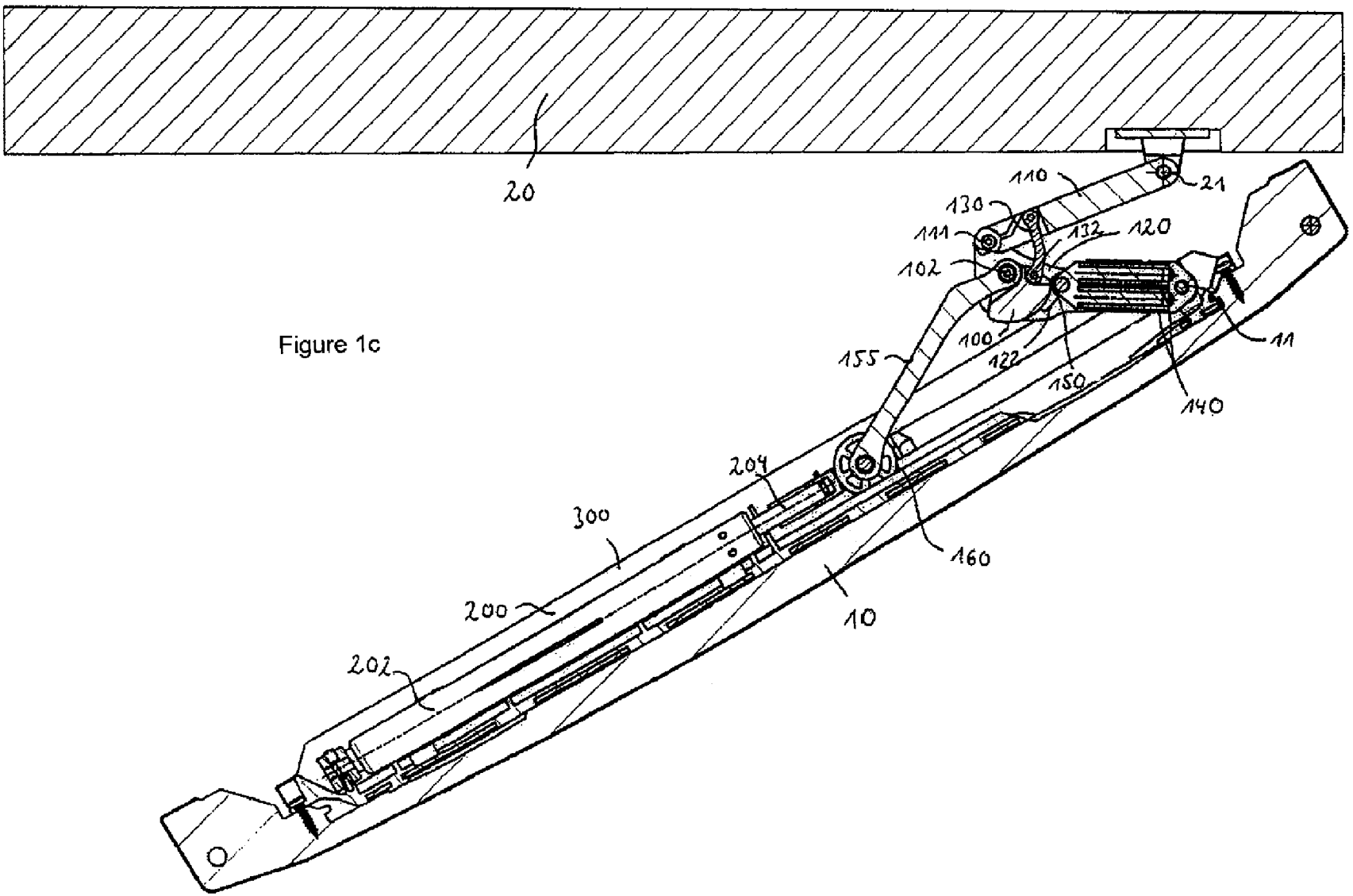
Figure 1D:
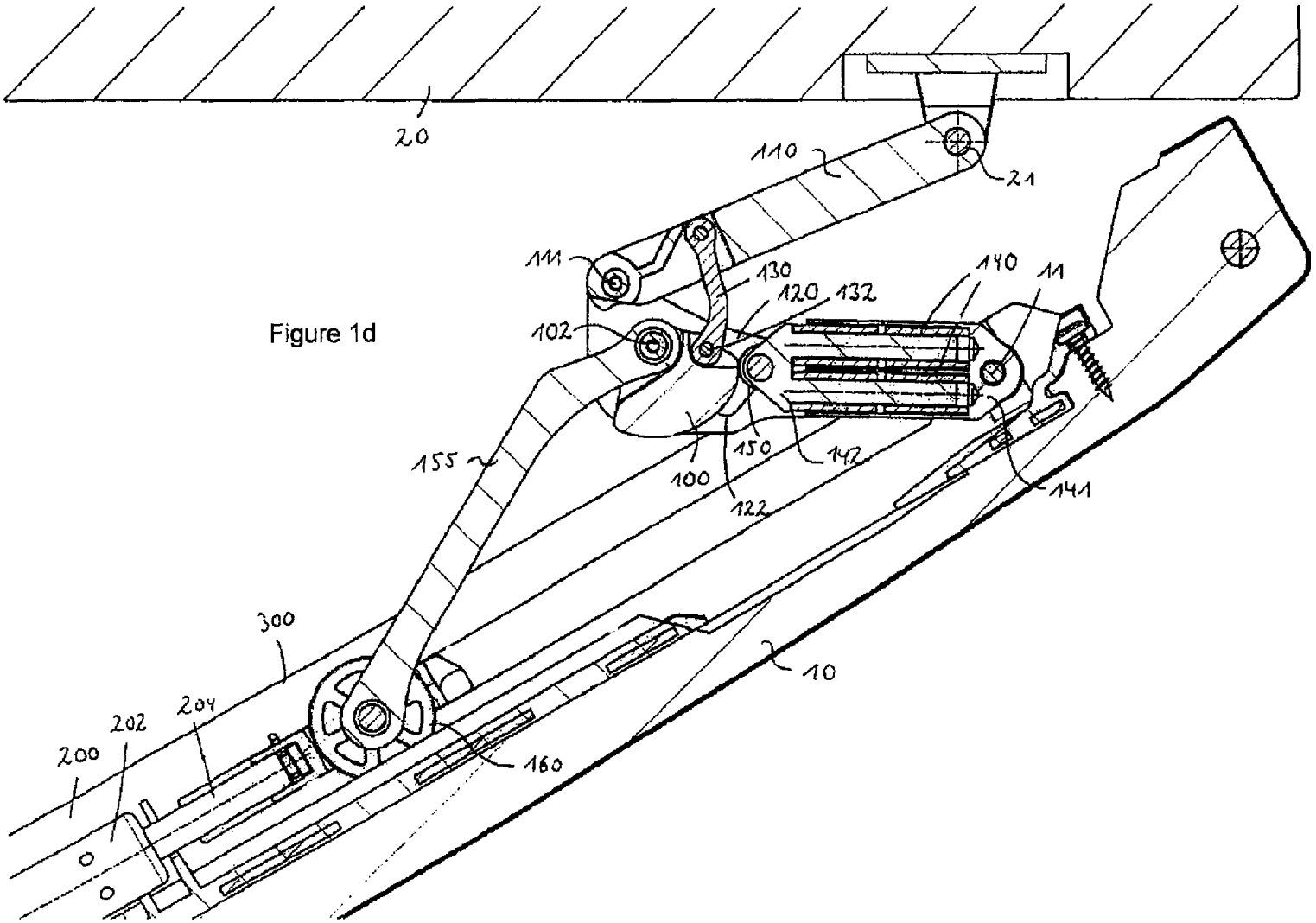
Figure 1E:
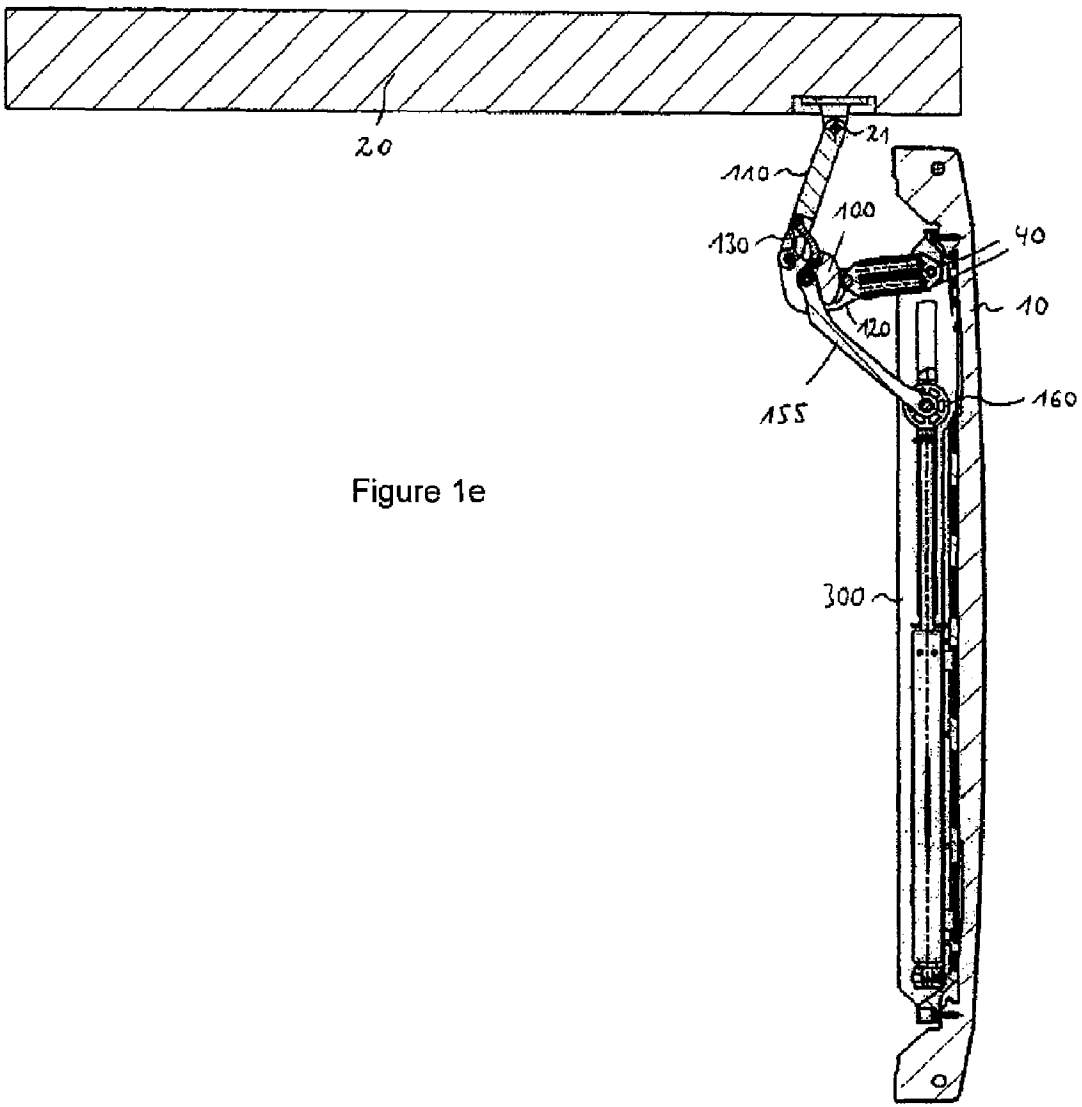
Figure 1F:
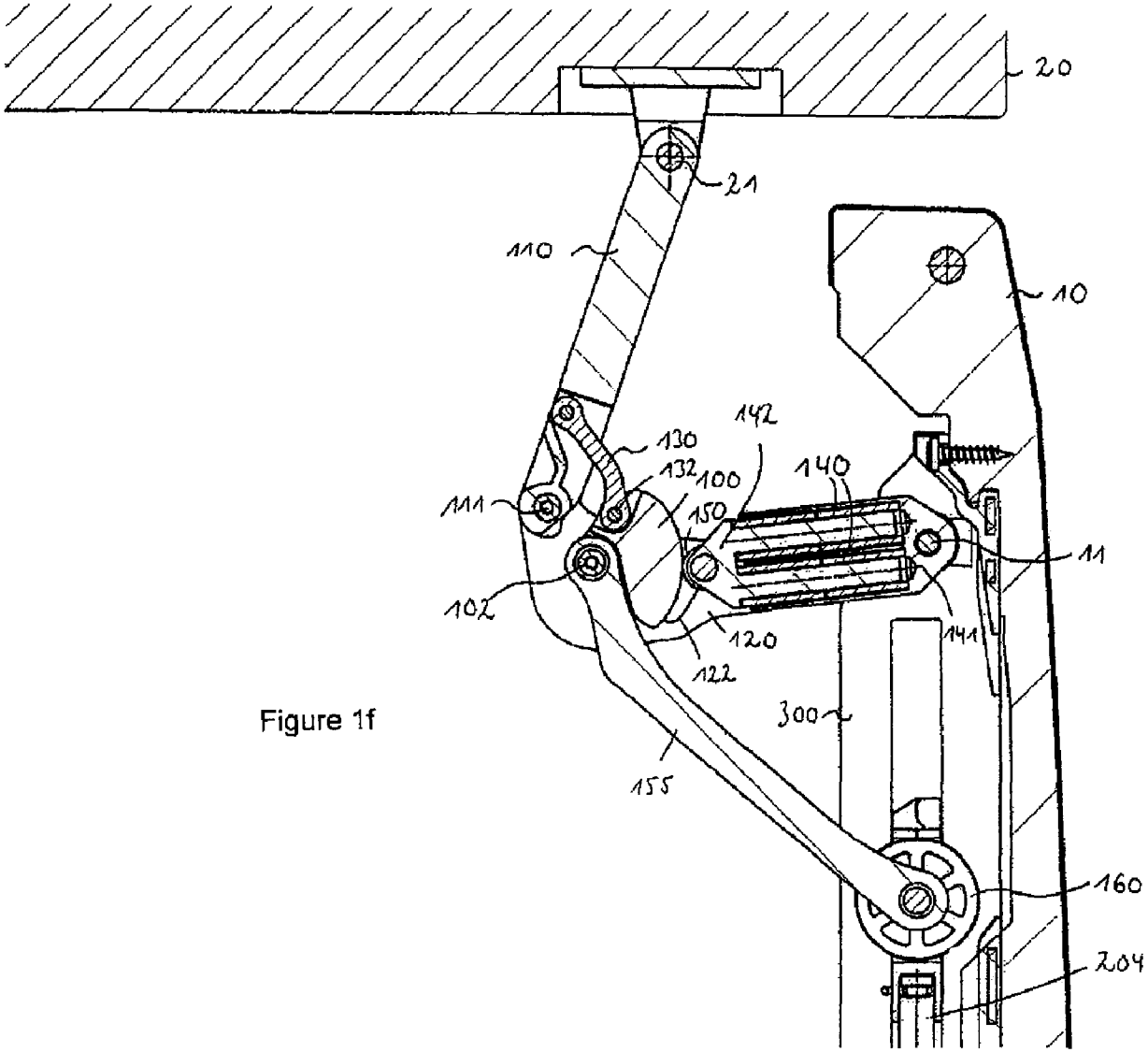
Figure 1G:
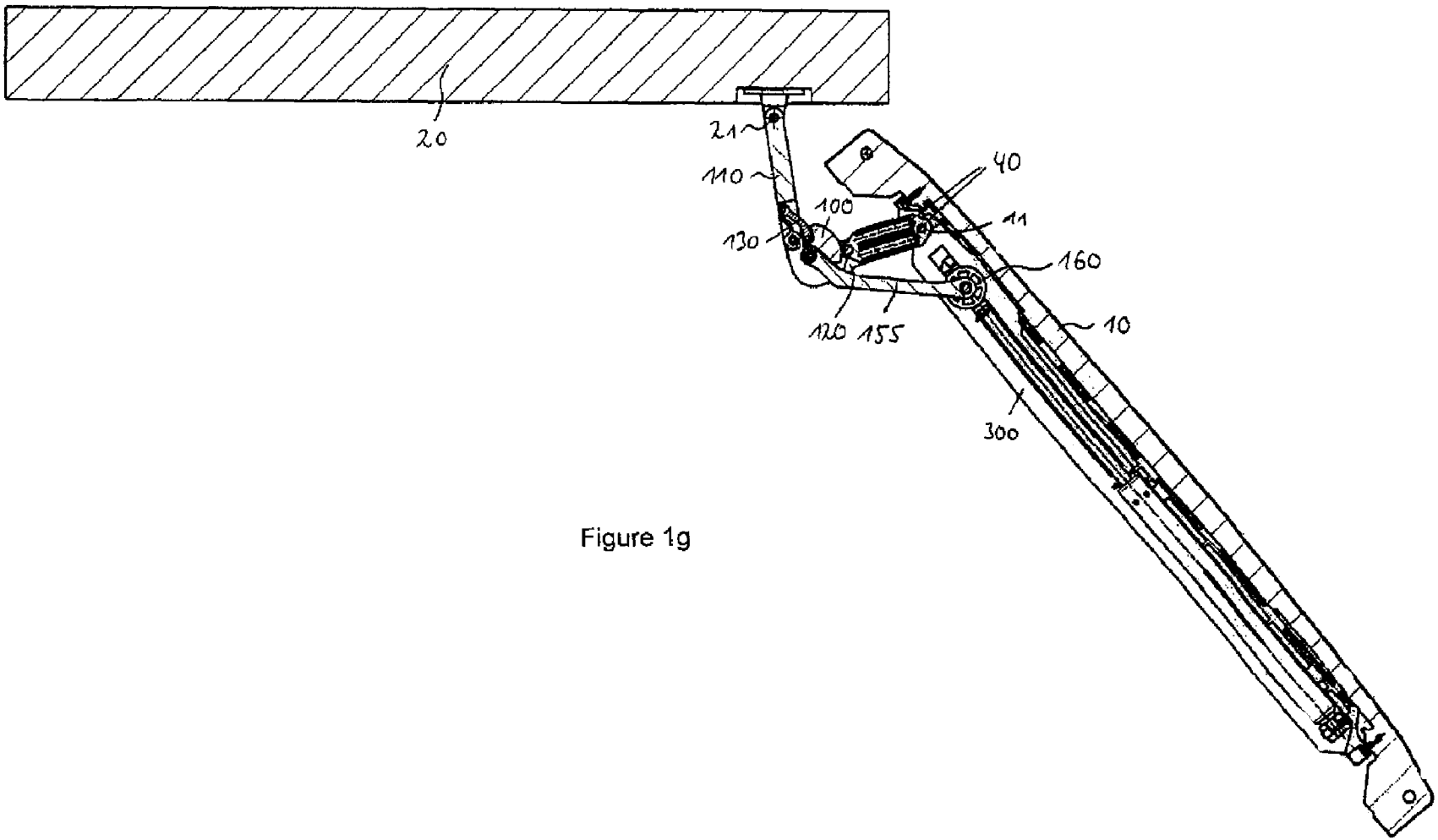
Figure 1H:
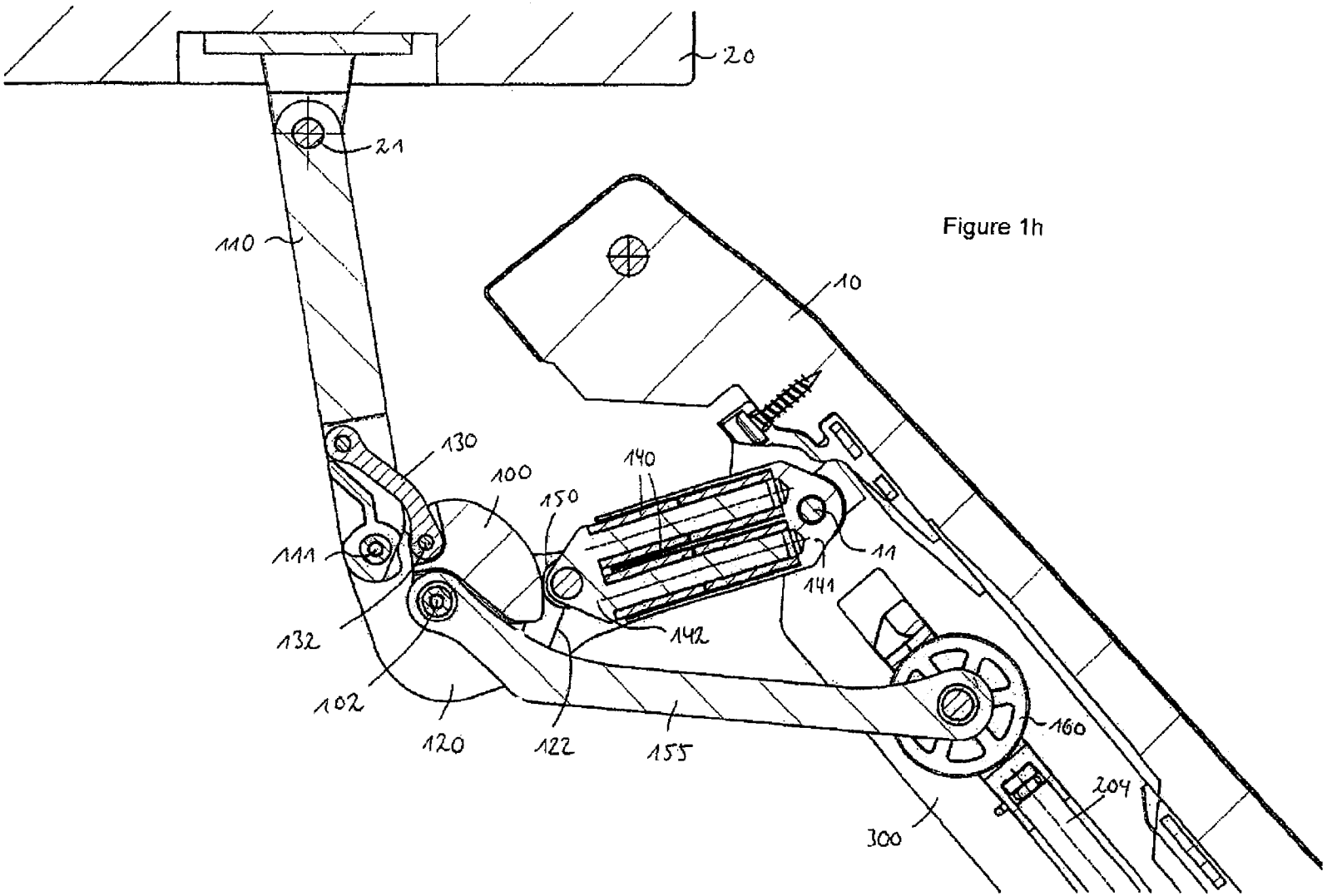
Figure 1I:
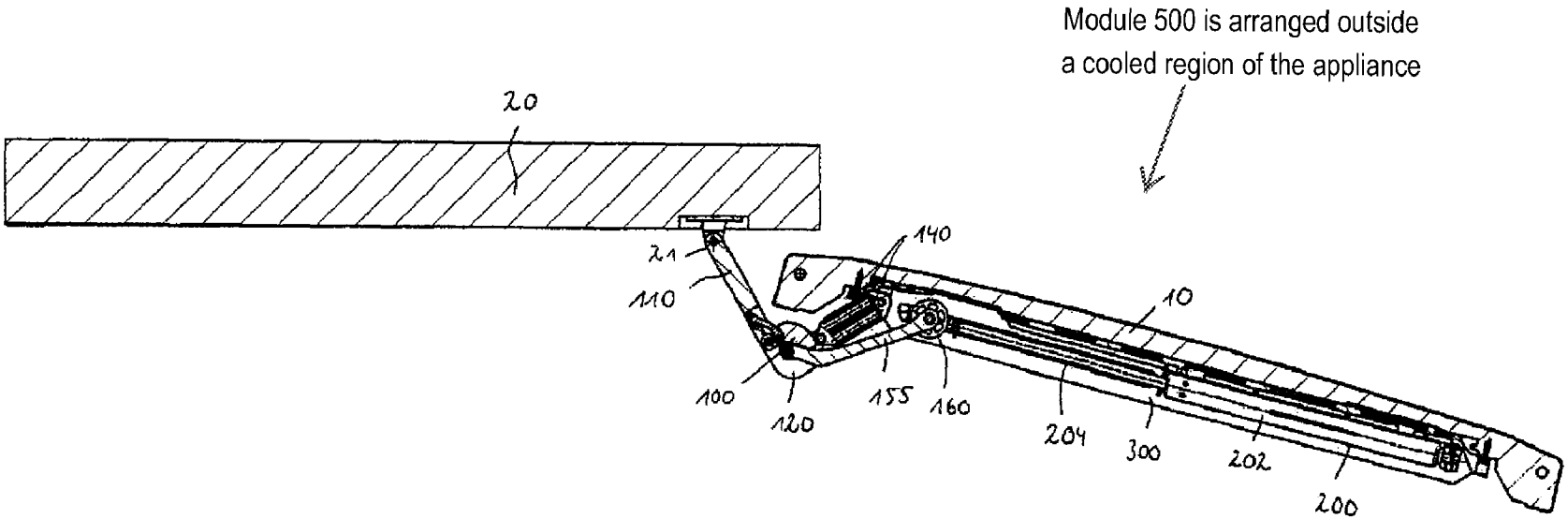
Figure 1J:
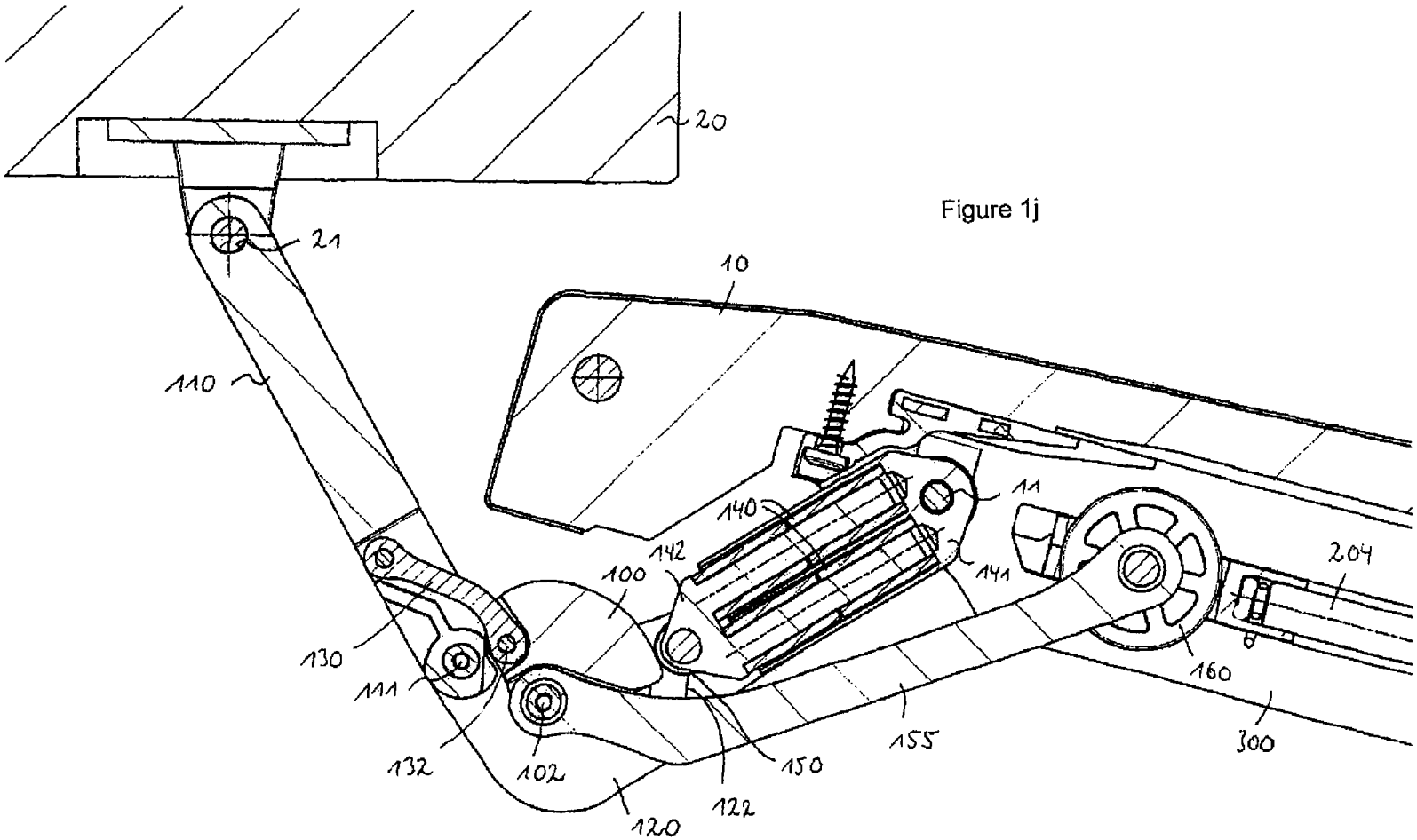
Figure 2A:
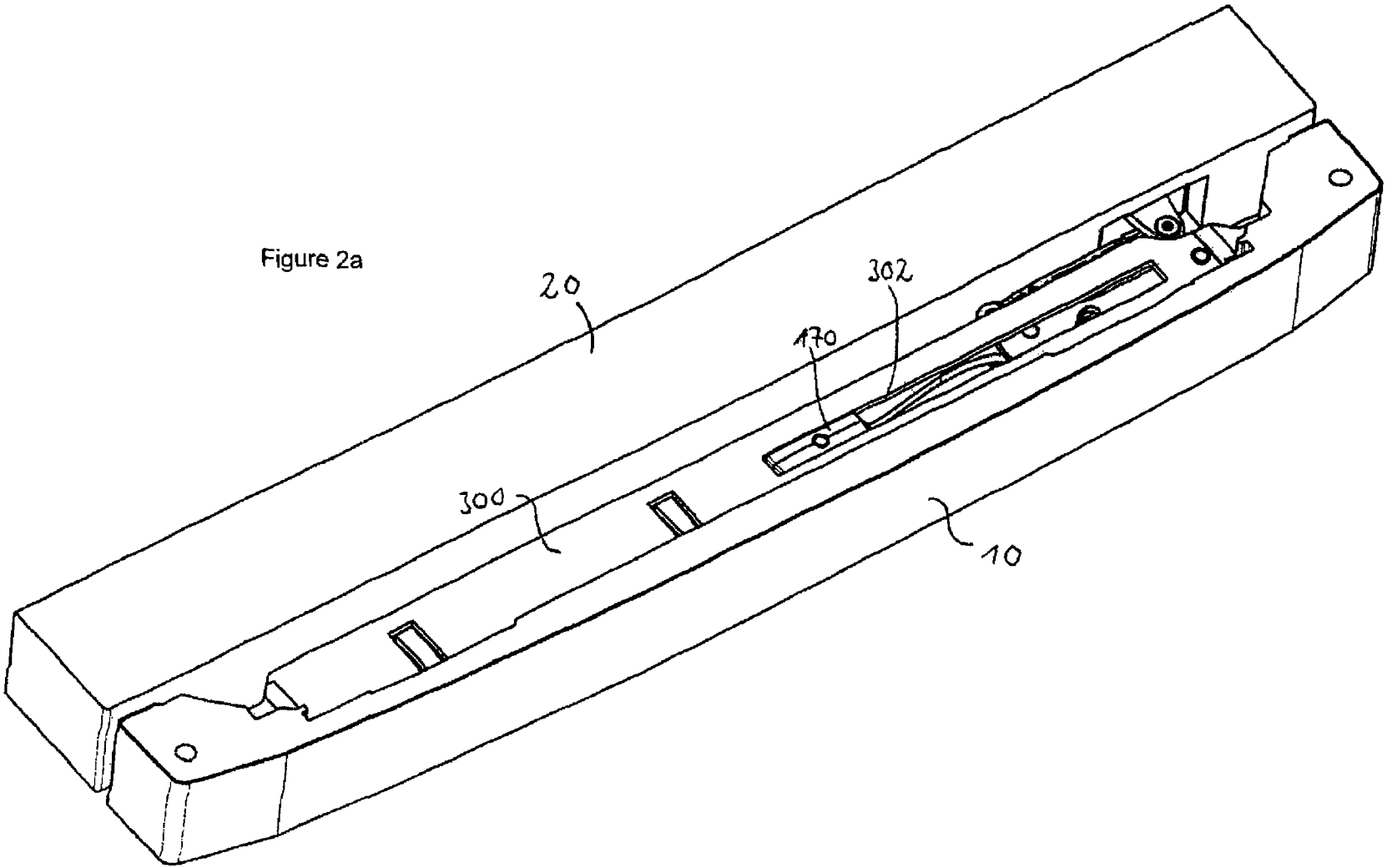
FIG. 2*a* to FIG. 2*e*: show the hinge with damper in accordance with the first embodiment of the invention in a perspective view with different opening angles.
Figure 2B:
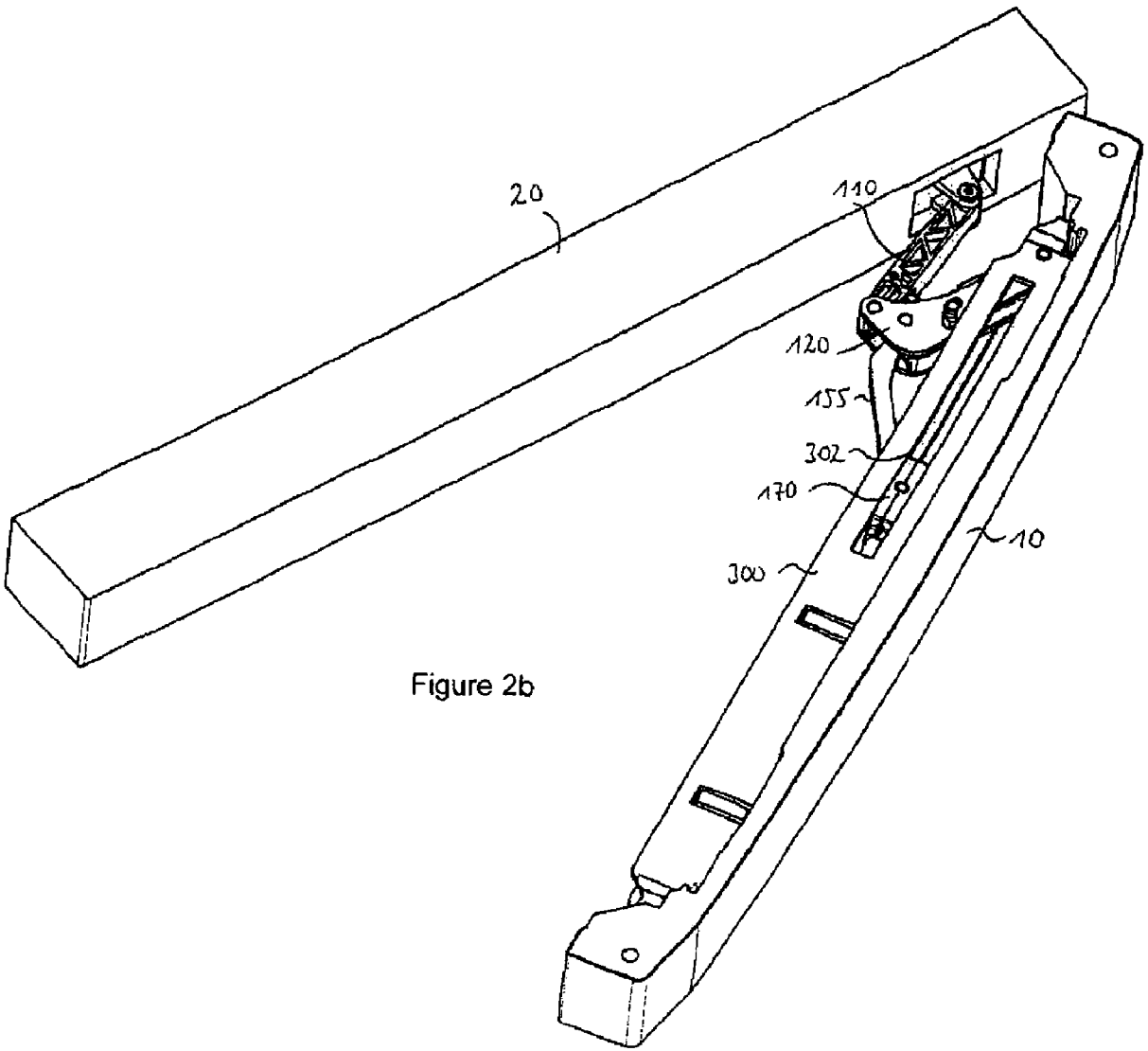
Figure 2C:
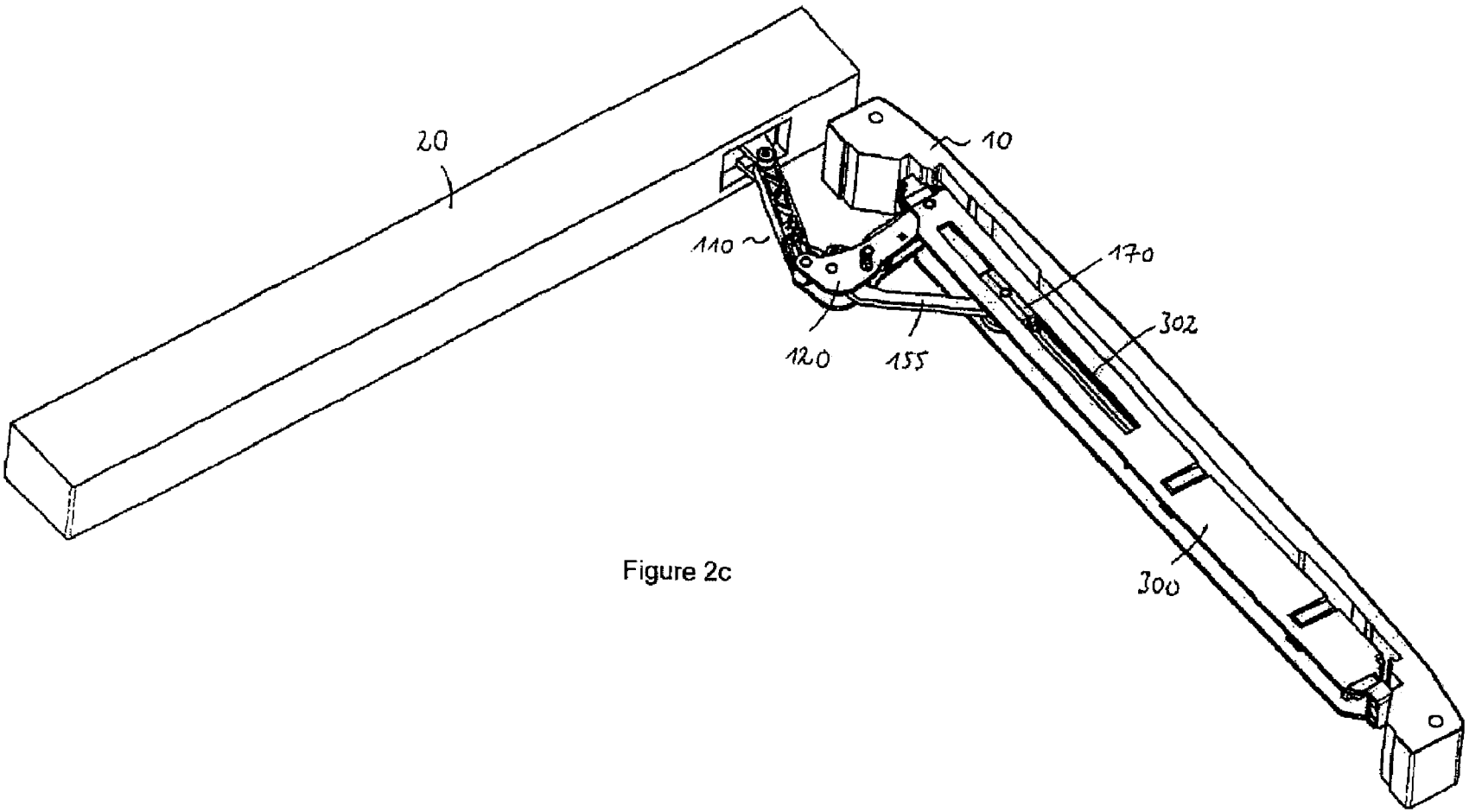
Figure 2D:
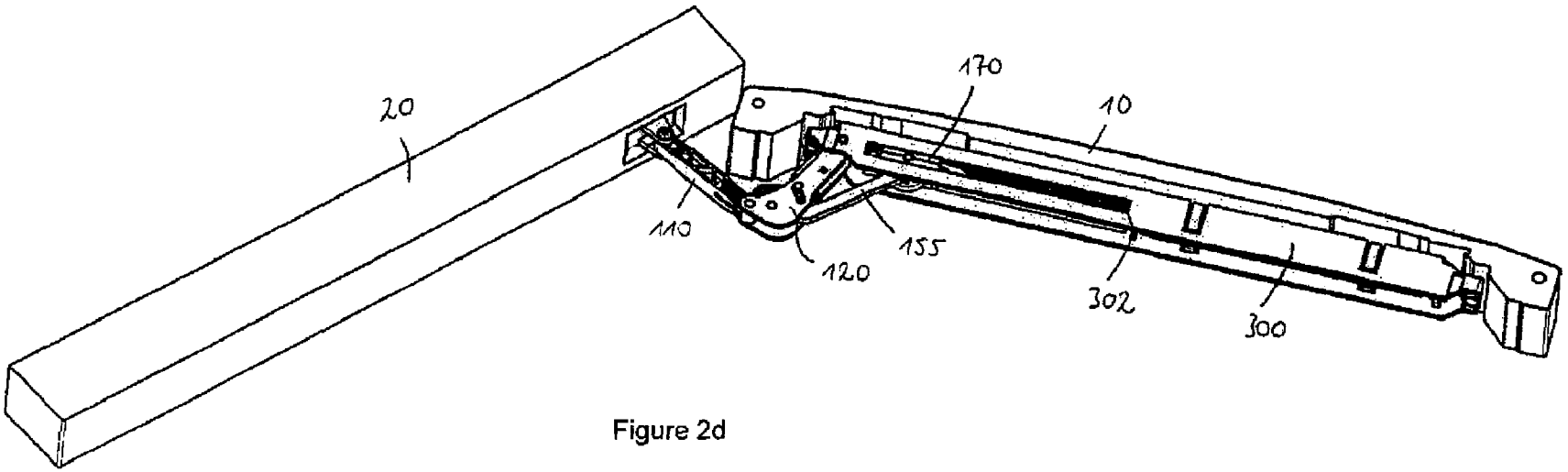
Figure 2E:
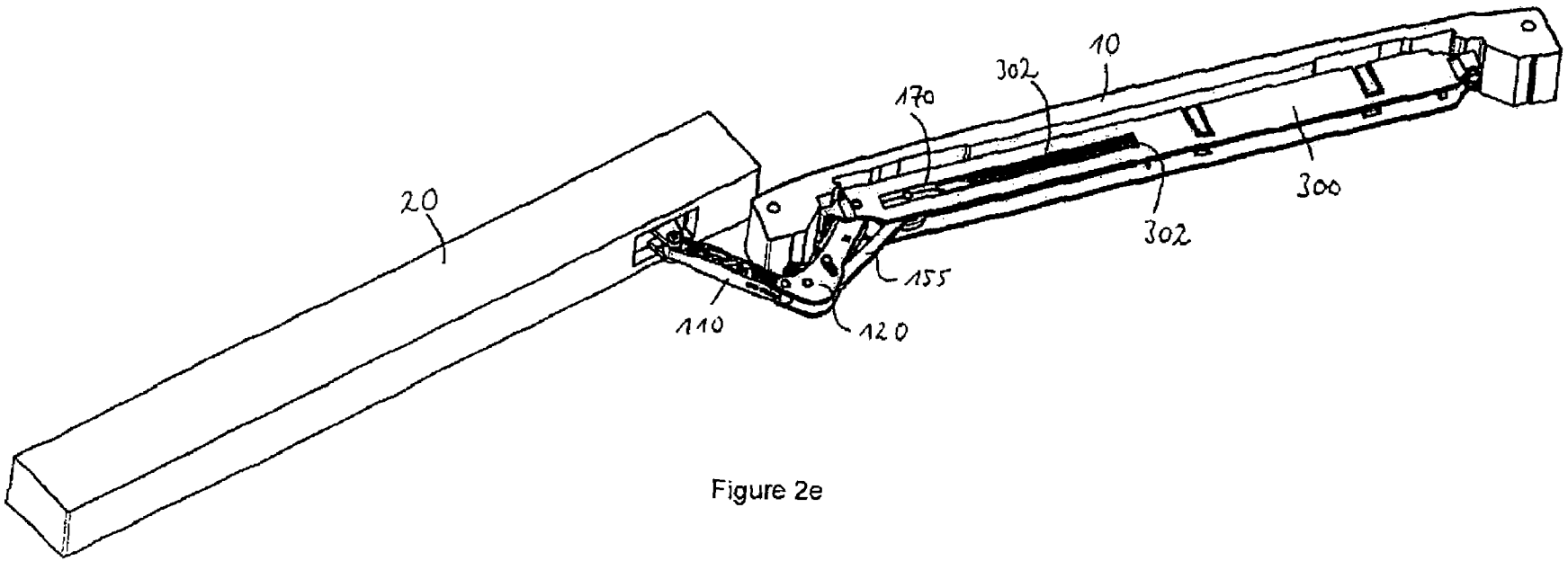
Figure 3A:
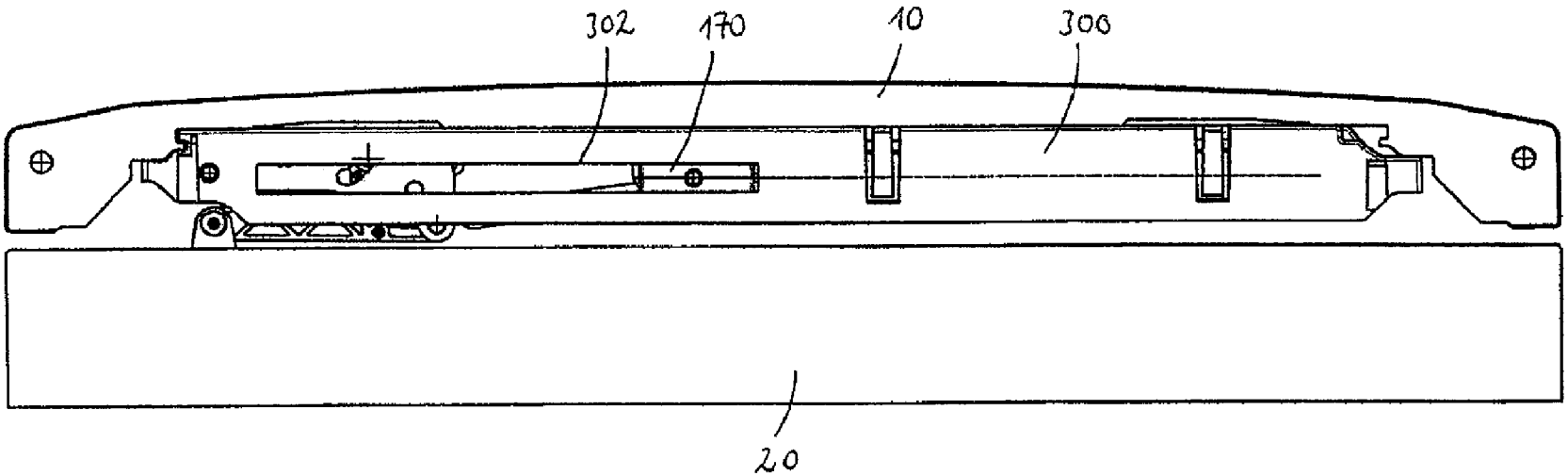
FIG. 3*a* to FIG. 3*e*: show the hinge with damper in accordance with the first embodiment of the invention in a top view with different opening angles.
Figure 3B:
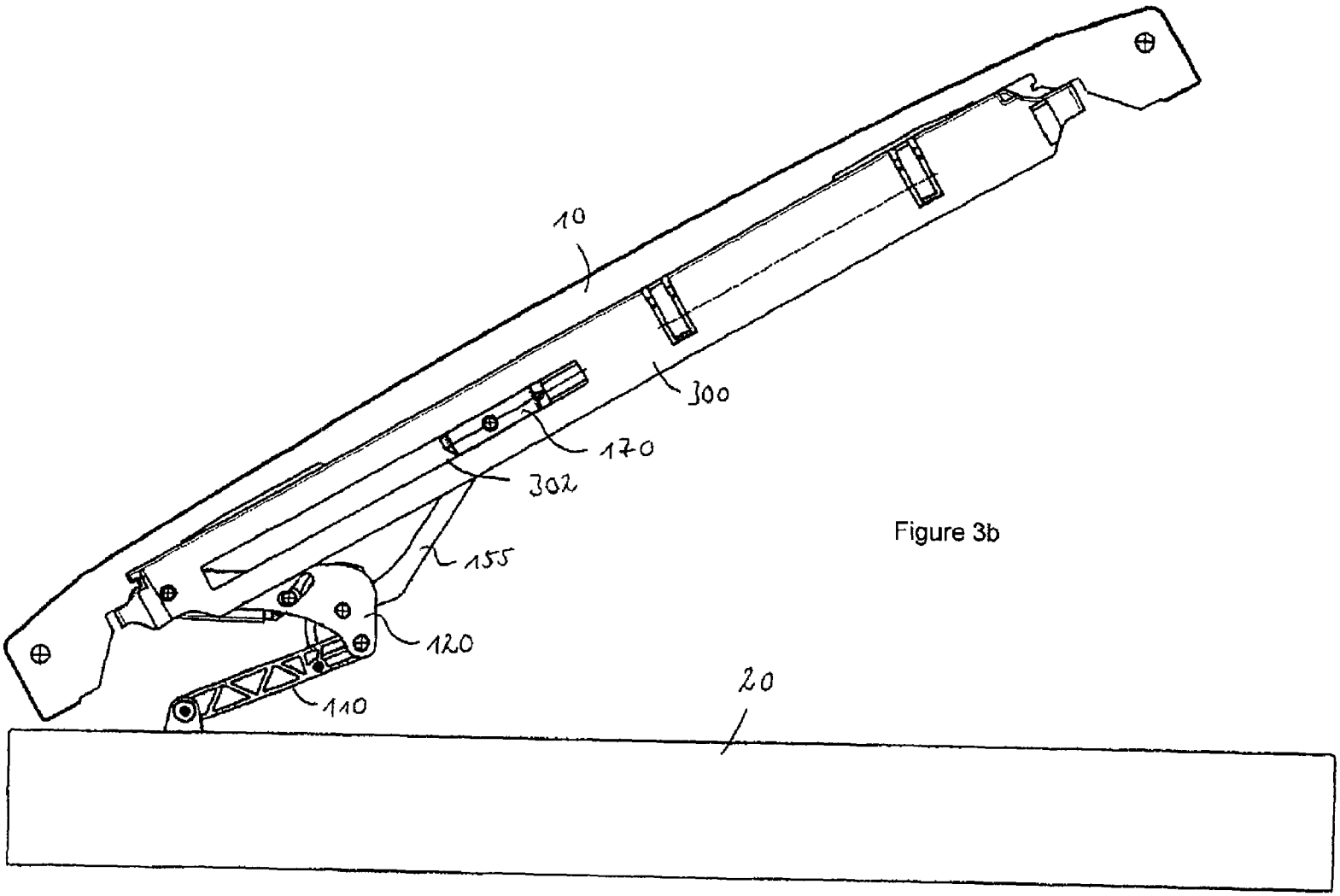
Figure 3C:
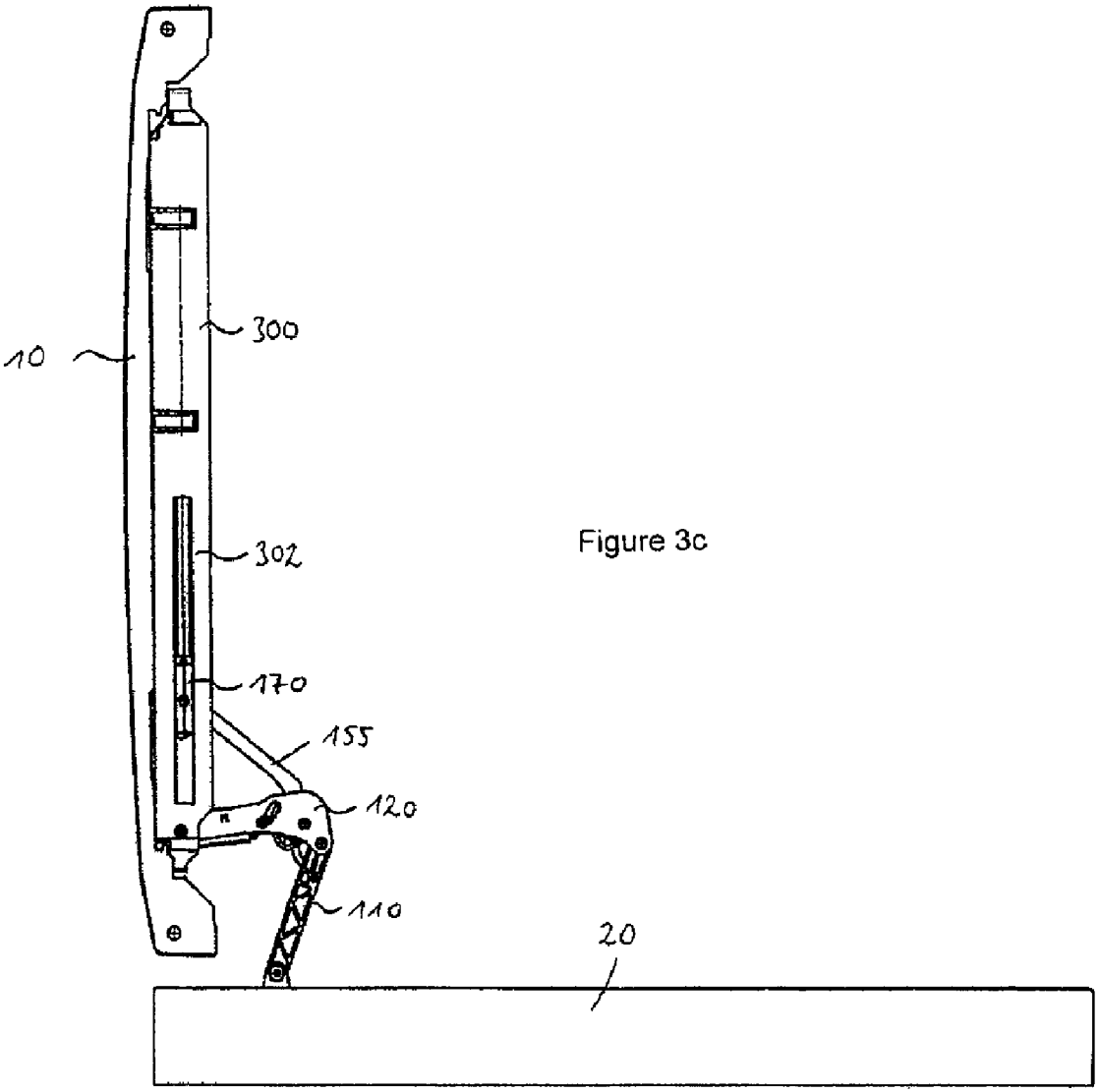
Figure 3D:
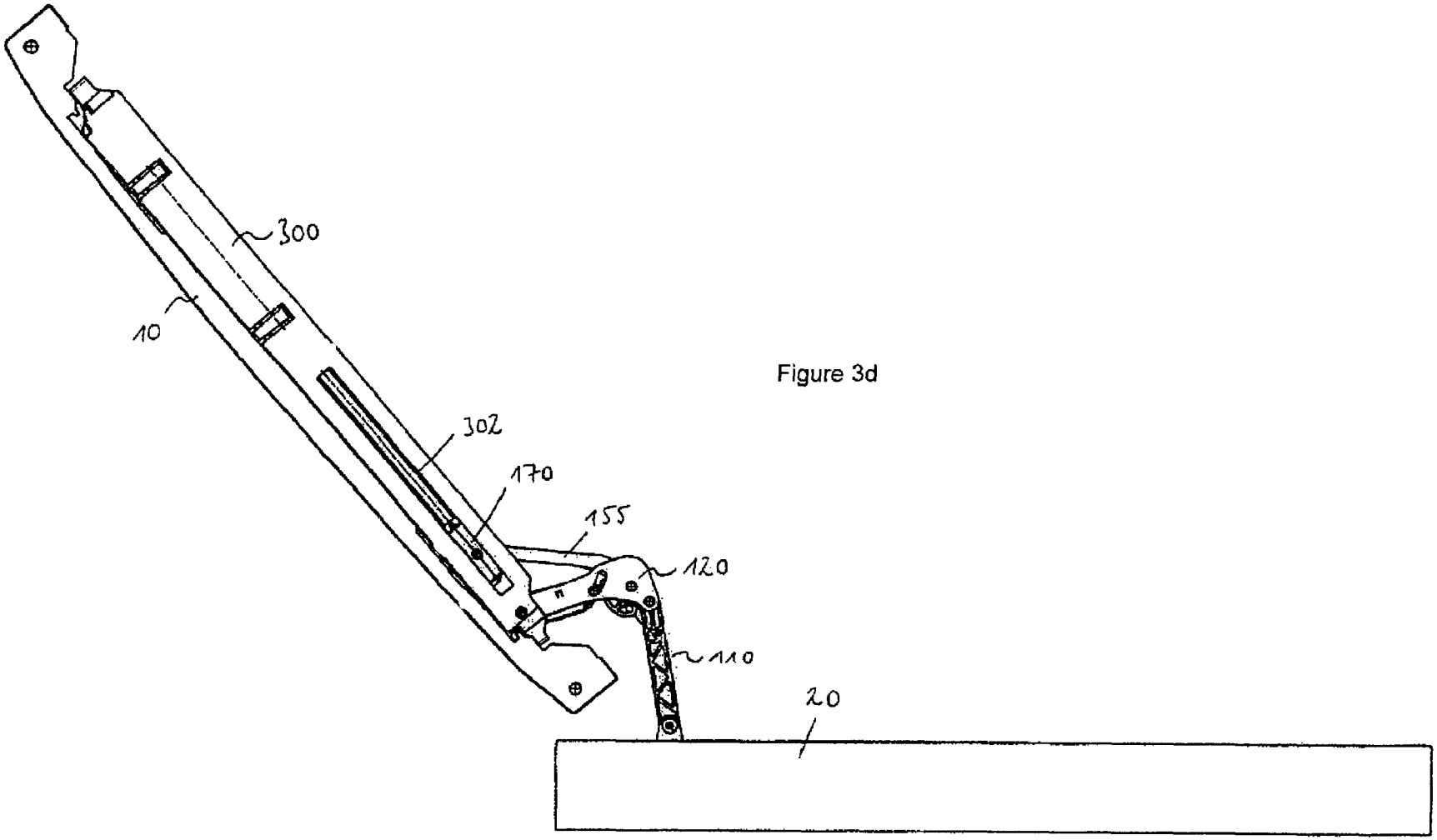
Figure 3E:
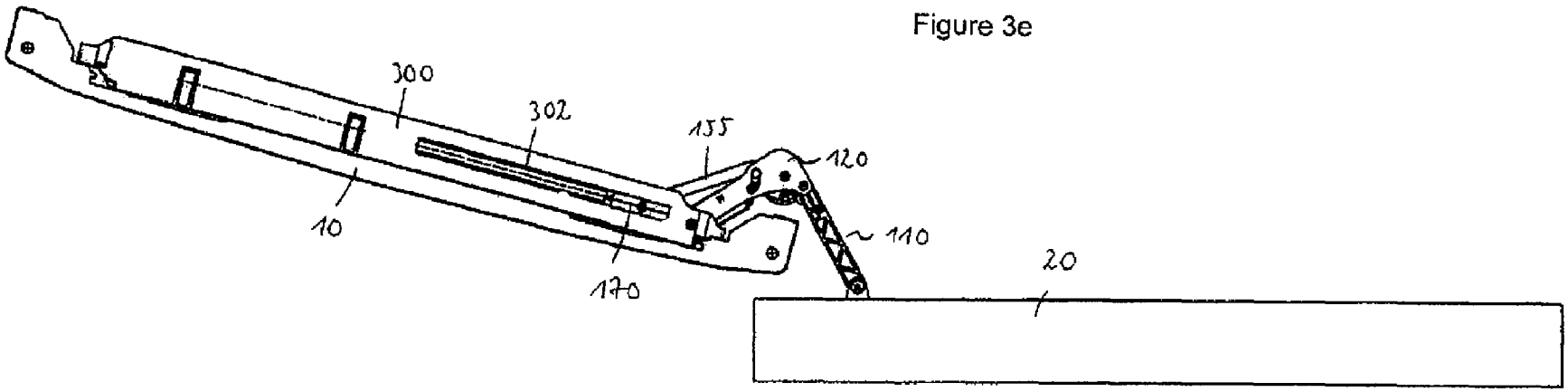

FIGS. 1*a*, 1*b* show the arrangement with closed door, FIGS. 1*c*, 1*d* with an opening angle of 30°, FIGS. 1*e*, if with an opening angle of 90°, FIGS. 1*g*, 1*h* with an opening angle of 130°, and FIGS. 1*i*, 1*j* with an opening angle of 165°.

Identical reference numerals in the Figures designate identical components or components having the same function, wherein not all reference numerals are indicated in all Figures for reasons of clarity.

The hinge connecting the body 20 with the door 10 consists of a first hinge lever 110 and a second hinge lever 120. Both hinge levers can be swivelled relative to each other about the pivot point 111. The first hinge lever 110 is pivotally attached to the body 20 of the appliance about the axis 21, and the second hinge lever 120 is pivotally attached to the carrier 300 about the axis 11, which carrier is secured by screws and positively accommodated in the door 10 of the appliance.

The eccentric 100 is pivotally attached to the hinge lever 120 about the axis 102. The eccentric is connected with the first hinge lever 110 via a tension lever 130. The tension lever 130 is pivotally connected with the first hinge lever 110 and with the eccentric.

With the second hinge lever 120 the compression spring pack is connected, which consists of a housing 141 (see FIG. 1*b*), in which two compression springs 140 are arranged. In the housing 141, the carriage 142 is movably accommodated, in whose terminal region directed towards the eccentric 100 at least one roller 150 is arranged, which runs on the eccentric surface of the eccentric 100. The compression springs exert a force on the carriage 142, which leads to the roller 150 being pressed onto the surface of the eccentric. The pivotal attachment of the compressive springs thus is located not on the damper 200, but on the carrier 300.

On the second hinge lever 120, the damper lever 155 is arranged, which in its one terminal region is pivotally connected with the second hinge lever 120 at the pivot point 102, and which in its second terminal region is provided with two rollers 160, which run on a guideway of the carrier 300.

FIG. 1*b* shows an enlarged representation of the hinge arrangement of FIG. 1*a*.

As can be taken from FIGS. 1*a* and 1*b*, the components of the hinge, the damper 200 and the damper lever 155 are substantially integrated in the door, when the door is closed. As can furthermore be taken from FIGS. 1*a* to 1*i*, the damper 200 of this embodiment always is located in the plane of the door independent of the opening angle of the door 10.

FIGS. 1*c*, 1*d* show the arrangement with a door opening angle of about 30°. This again clearly shows that the tension lever 130 on the one hand is pivotally attached to the eccentric 100 and on the other hand to the first hinge lever 110. Furthermore, it can be seen that the position of the roller 150 relative to the surface of the eccentric 100 changes when the door is opened, as can be taken more clearly from the Figures explained below.

FIG. 1*c* furthermore shows that when the door is opened, the piston rod 204 is withdrawn further from the cylinder 202 of the damper 200 with increasing opening angle. Correspondingly, the reverse process takes place, i.e. the piston rod 204 is pushed into the cylinder 202, and hence the damping effect is obtained when the door is closed.

FIG. 1*d* shows the arrangement of FIG. 1*c* in an enlarged representation.

FIG. 1*e*, if show the arrangement with a door opening angle of 90°. In this position of the door, the roller 150 is located in a middle region of the surface of the eccentric 100. The contouring of the surface of the eccentric 100 is made such that in the embodiment shown here the compression springs 140 do not exert any torque producing a closing force on the eccentric 100 from an opening angle of about 55°. This means that the door stops in the position into which it has been moved by the user of the appliance.

FIGS. 1*g* and 1*h* show the door with an opening angle of about 130°, and FIGS. 1*i* and 1*j* show the door with a door opening angle of about 165°.

The arrangement shown in FIGS. 1*a* to 1*j* provides for realizing a door closing behavior, with which in an initial angular range, for instance with opening angles <55°, door closing and, in larger angular ranges, door stopping is effected.

The carrier 300 with the components arranged thereon can easily be removed and, for instance when changing the door stop, can again be inserted at some other point, without the necessity of having to individually dismount and then again mount the components of the hinge or damper.

The carrier 300 or the module 500 can be mounted for instance at the bottom or at the top of the refrigerator or also on a cross-beam arranged at a middle level. Preferably, the carrier or the module is arranged such that no weakening of the insulation is obtained. This can be achieved for instance in that the damper 200 and with the same also the carrier 300 is inserted in transverse direction, i.e. in the plane of the door 10 or in the plane formed by the body front. Further, as shown in FIG. 1*i*, module 500 may be arranged outside a cooled region of the appliance.

Preferably the carrier 300 and the damper 200 is horizontally integrated in the door 10 or in the body 20 of the appliance.

Due to the flexibility, the arrangement of the invention can also be used advantageously in double-door appliances.

Another advantage of the present invention consists in that the damper can be arranged such that it is guided, so that even shocks can easily be absorbed.

Preferably, the hinge is configured such that only hinge elements exist which are subjected to tension or to compression, i.e. no torques occur in the articulated arms of the hinge.

FIGS. 2*a* to 2*e* show perspective representations of the arrangement of the invention with opening angles of 0°, 30°, 90°, 130° and 165°. It can be taken from this representation that the damper is arranged in a carrier 300, which as such is inserted into the door 10 or also into the body 20 of the appliance.

In the carrier, a groove 302 is disposed, in which sliding elements 170 are running, which can be taken from FIGS. 2*a* to 2*e*. Like the rollers 160, the sliding elements 170 also are arranged in the terminal region of the damper lever 155 and are running in the groove 302 of the carrier 300, when the door is opened and closed.

FIGS. 3*a* to 3*e* show the arrangement of the invention in a top view with opening angles of 0°, 30°, 90°, 130° and 165° and again illustrate the arrangement of the sliding element 170 in the groove 302 of the carrier 300.

Figure 4:
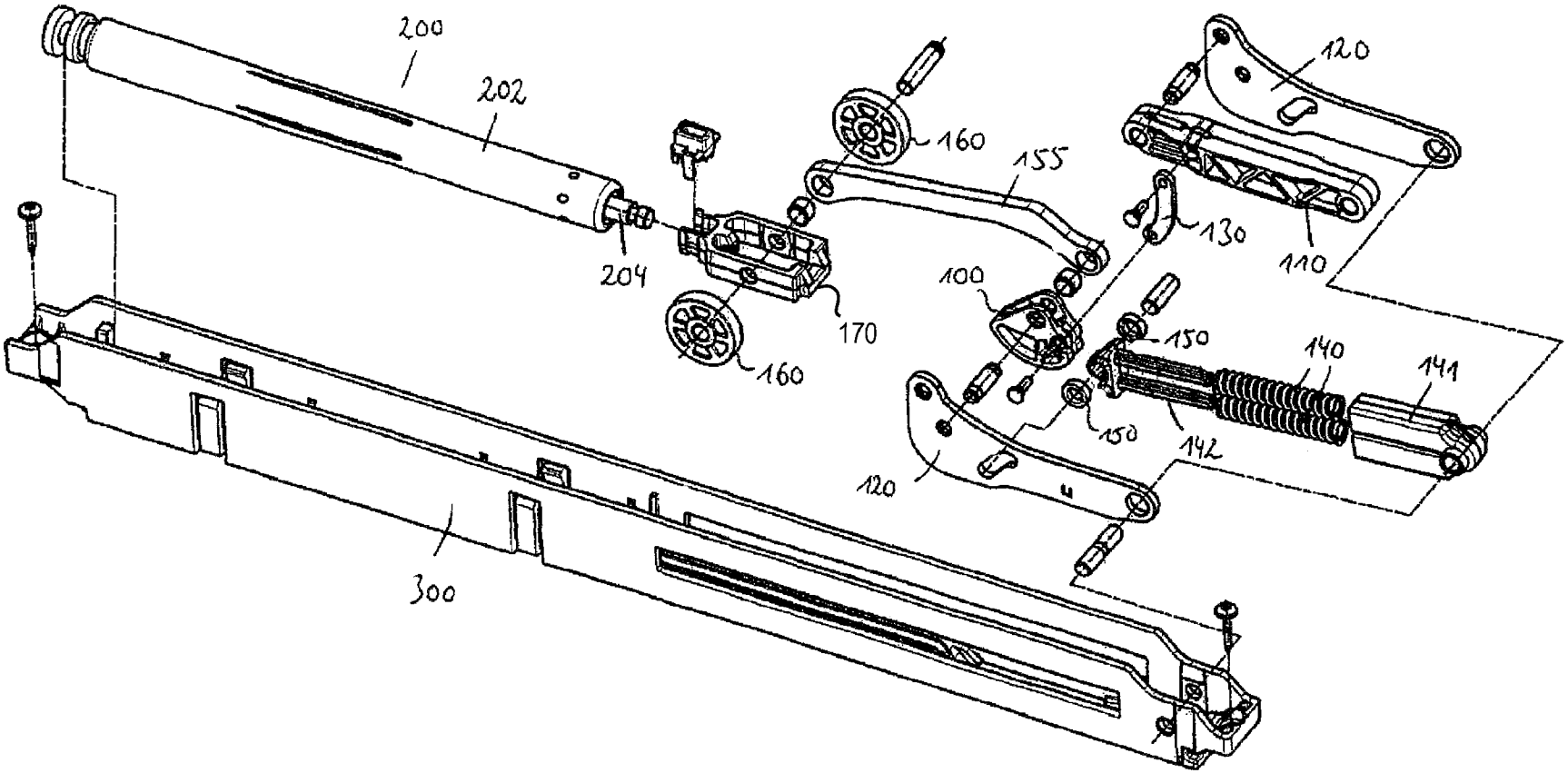
FIG. 4: shows an exploded view of the hinge with damper in accordance with the first embodiment of the invention.
Figure 5A:
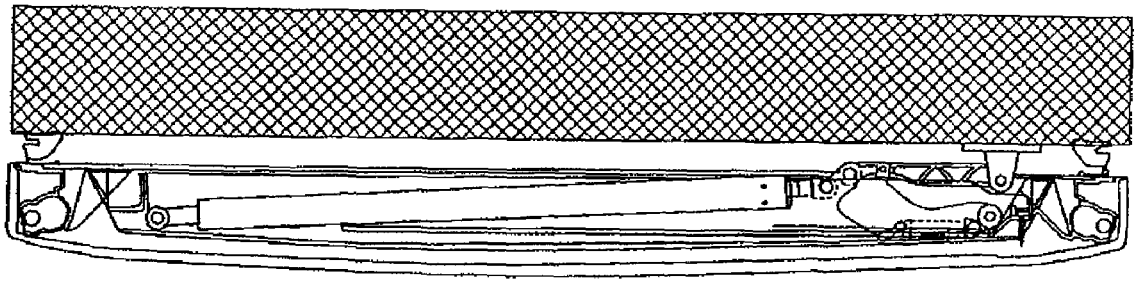
FIG. 5*a* to FIG. 5*d*: show an alternative second embodiment of the hinge with damper in accordance with the invention with different opening angles.
Figure 5B:
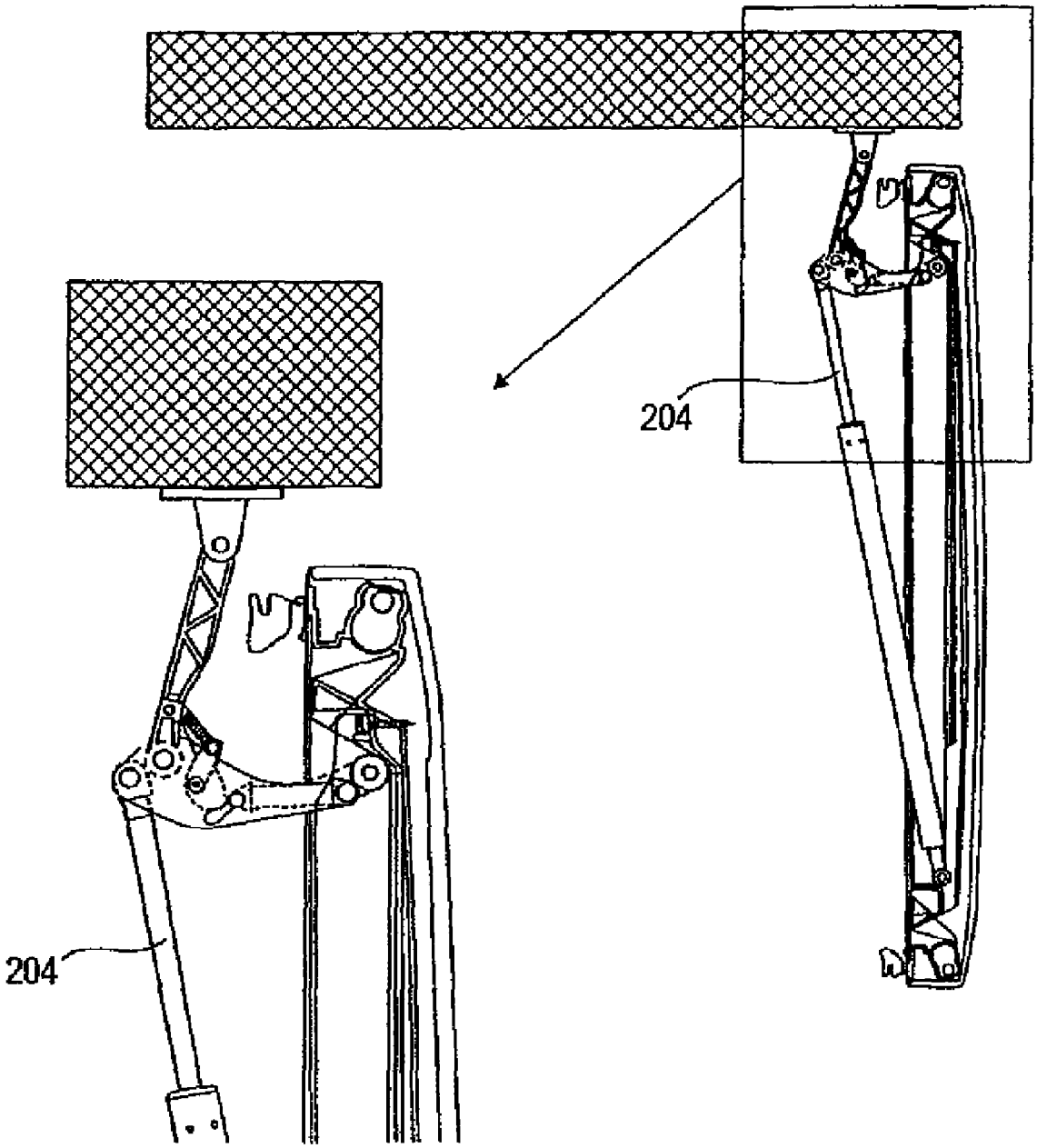
Figure 5C:
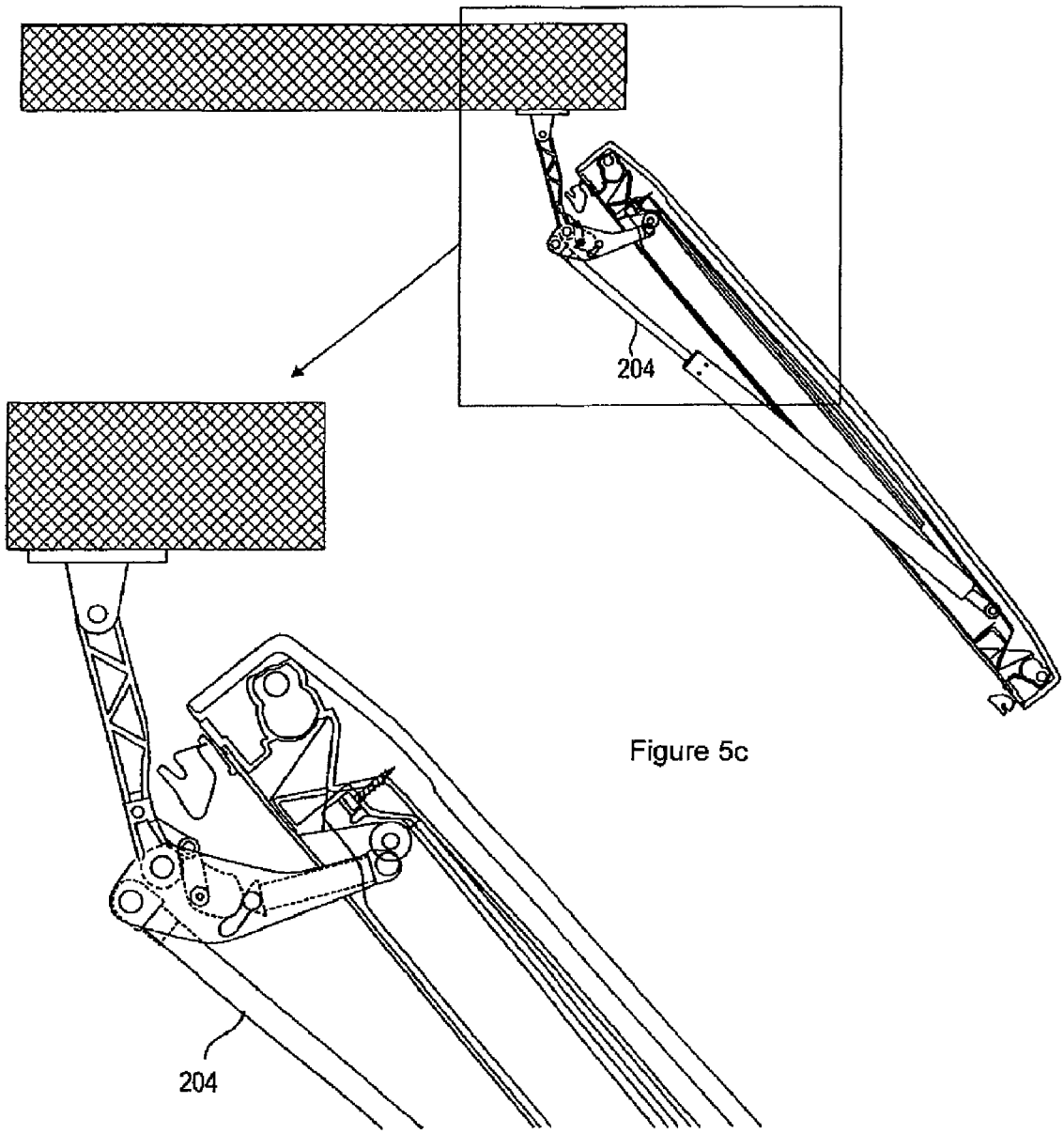
Figure 5D:
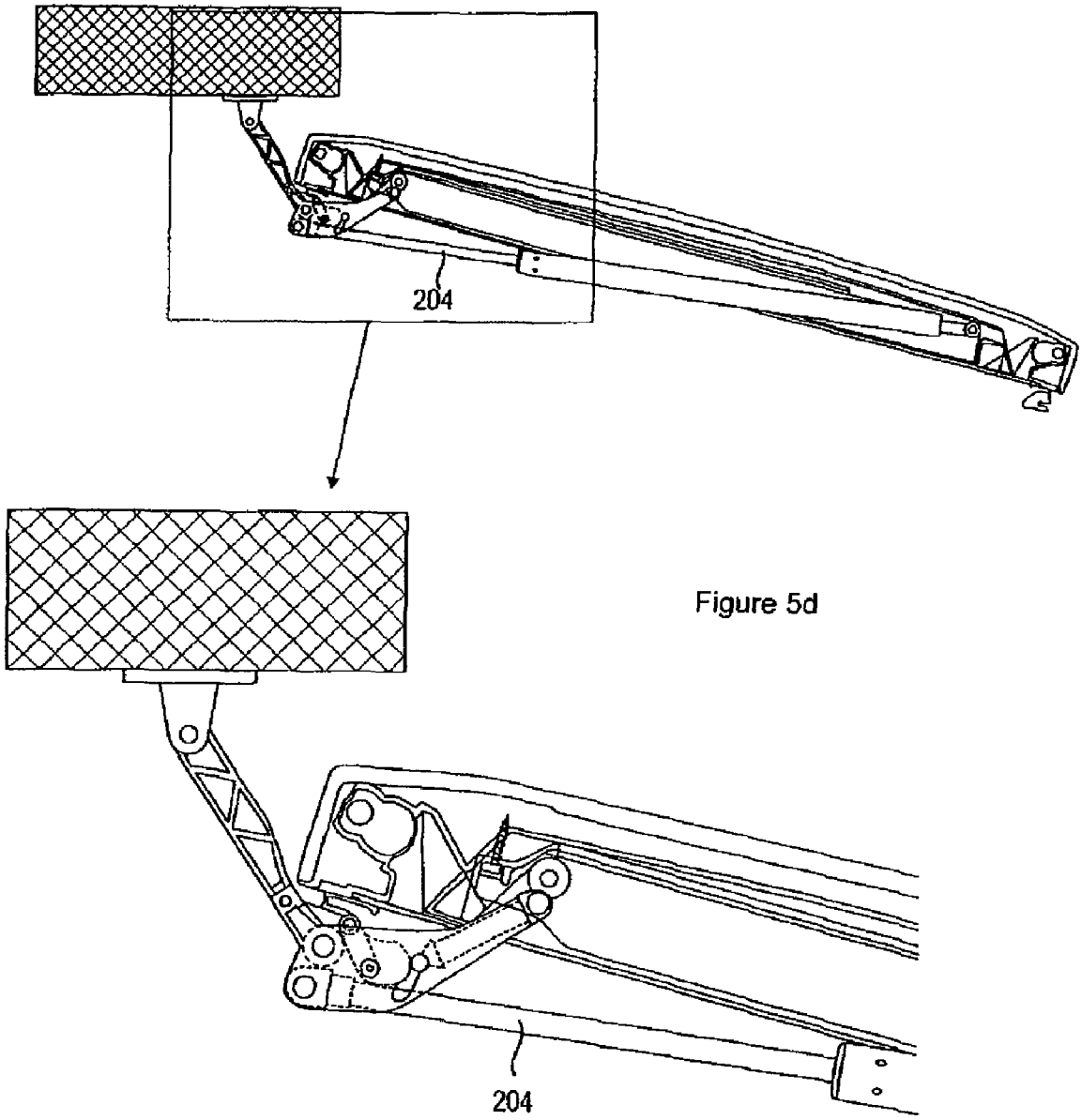

FIG. 4 shows the parts of the arrangement of the invention in an exploded view.

The carrier can for instance be a plastic-coated metal part, which is latched in a corresponding recess of the door or of the body and is fixed by screws, if necessary. In principle, an exclusively positive insertion is recommendable, since in this way the carrier 300 can be inserted particularly easily and can be replaced or mounted elsewhere, if necessary.

By using a carrier 300, an optimum of rigidity and functions can be achieved. In particular, the occurring forces of the damper can be absorbed by the carrier 300. In addition, a design optimized in terms of assembly and a selection of materials meeting functional requirements can be performed for the sliding guideway.

Another advantage of the damper consists in that the door can be prevented from bouncing back when it is closed at high speed.

If the damper is guided linearly, as this is the case in the embodiment of FIGS. 1*a* to 1*j*, a further advantage beside the advantage that the damper need not absorb any transverse forces consists in that almost the entire unit can be covered, which offers an increased safety and advantages in terms of design.

The damper 200 also preferably is latched in the carrier 300, without further fastening means being required.

An essential feature of the arrangement shown in FIGS. 1 to 4 consists in that the damper 200 and hence also the piston rod 204 always runs in the carrier 300 independent of the opening angle of the door 10, which involves the advantage that the damper 200 is running with particularly little friction, since possibly existing transverse forces do not act on the damper or its piston rod 204.

In contrast thereto, FIGS. 5*a* to 5*d* show an arrangement, in which the piston rod 204 is not connected with the hinge via a damper lever, but directly. Otherwise, the construction of the hinge corresponds to that shown in FIGS. 1 to 4. FIGS. 5*a* to 5*d* show the arrangement likewise comprised by the invention with an opening angle of 0°, 90°, 130° and 165°. In the arrangement shown in FIGS. 5*a* to 5*d* there is also provided a carrier 300, which is accommodated in a recess of the door. To allow the damper 200 to swivel out of the carrier 300, the damper is pivotally arranged in the carrier 300.

Figure 6A:
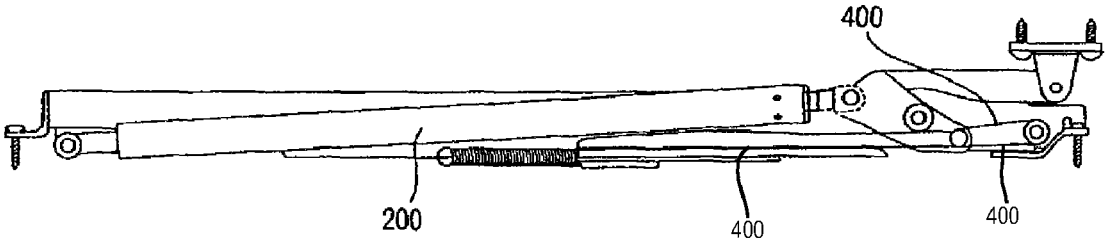
FIG. 6*a* to FIG. 6*c*: show a further third embodiment of the hinge and damper in accordance with the invention with a closed door in different perspectives.
Figure 6B:
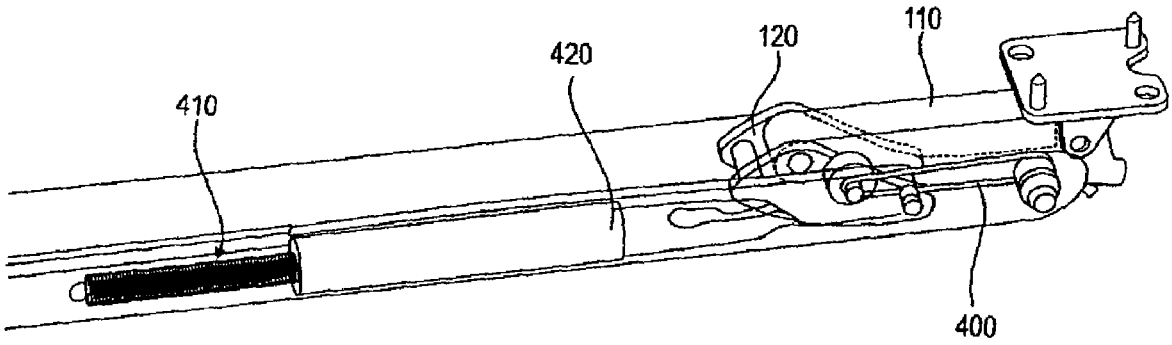
Figure 6C:
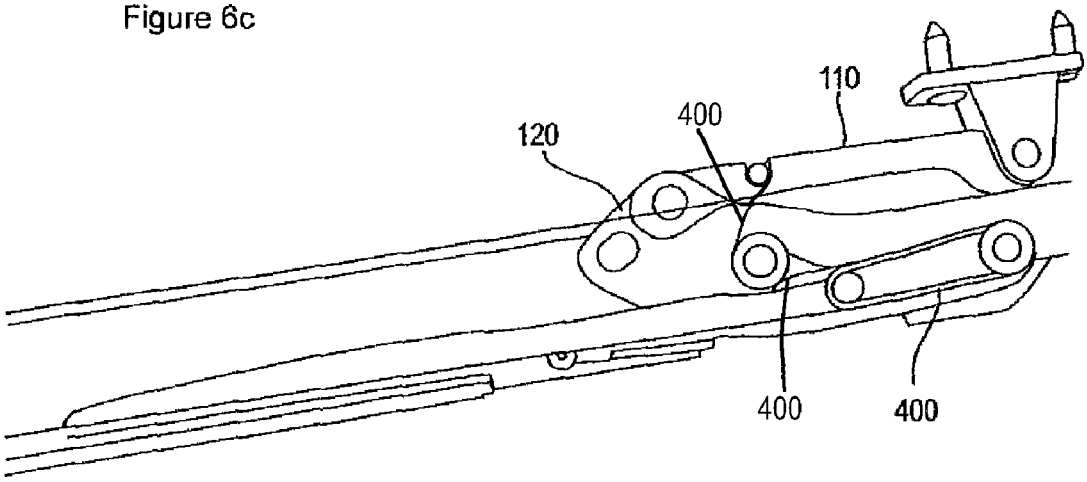

FIG. 6 shows an arrangement in which the eccentric and the compression springs are replaced by a Bowden cable arrangement. In this case, too, the damper 200 swivels out of the door when the door is opened, but the door closing function is produced via a Bowden cable 400, which in one terminal region is connected with one of the hinge levers 110 and with the other end with the tension springs 410, 420. The Bowden cable 400 is connected with the hinge lever 110 approximately at the position in which the tie rod 130 is pivotally attached to the hinge lever 110 in the embodiments of FIGS. 1 to 4. FIG. 6*a* shows the arrangement with damper 200, and FIGS. 6*b* and 6*c* without damper.

Figure 7:
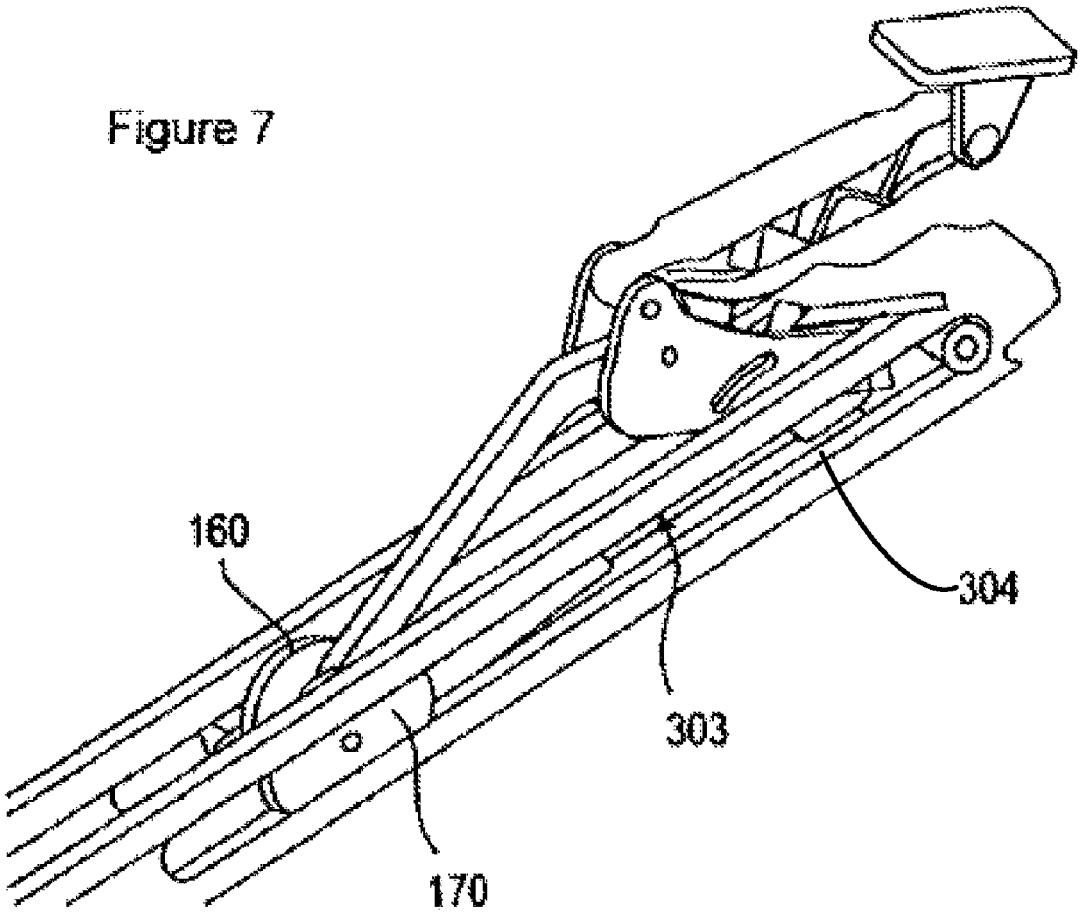
FIG. 7: shows a detailed representation of the hinge in accordance with the first embodiment of the invention.

FIG. 7 shows the groove 302 of the carrier 300. It can be taken from this Figure that the sliding elements 170 are running in the groove 302. When closing the door, the supporting effect is produced by the roller 160 in the embodiment shown here. When opening the door, however, the upper side of the groove 303 forms the abutment. Alternatively, it is conceivable to omit the rollers and to effect abutment not only when opening the door, but also during the closing operation via the sliding elements 170 or via the groove 302. Reference numeral 304 designates the abutment of the groove 302 getting into engagement via pure sliding friction.

Figure 8:
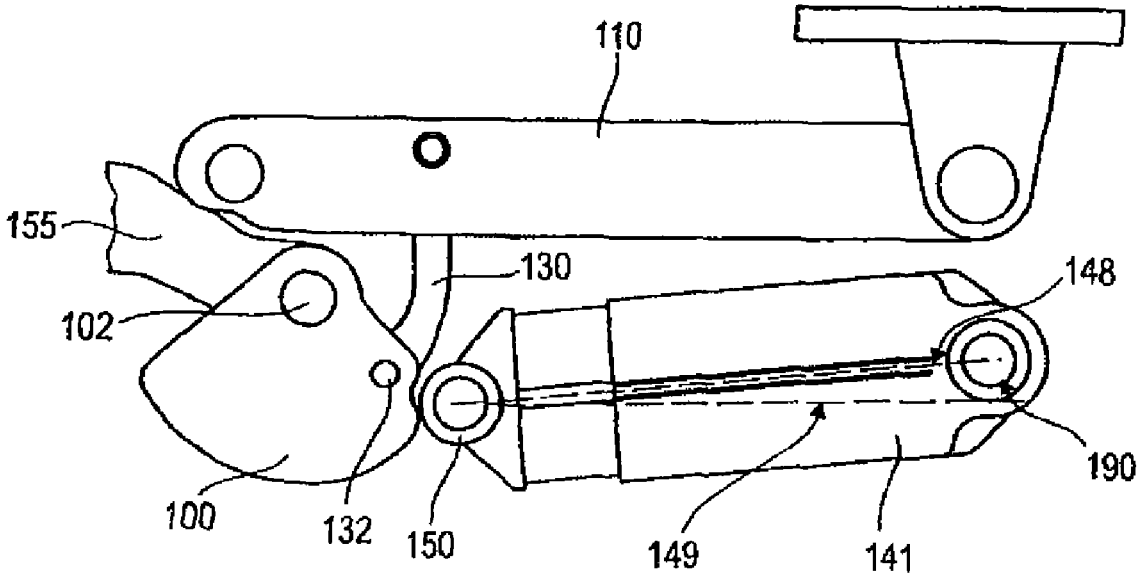
FIGS. 8, 9: show detailed representations of the eccentric with compression spring unit in accordance with the first embodiment of the invention.

FIG. 8 shows an enlarged representation of the eccentric 100 and the compression spring arrangement, by means of which a compressive force is exerted on the surface of the eccentric 100 via the rollers 150. By possible replacement of the two compression springs by other springs with different characteristics, the spring force and hence also the door closing force can be varied. Another possibility of influencing the door closing force consists in that the pivot point of the housing 141 illustrated here, which accommodates the springs 140, is effected by means of an eccentric bolt 190, which leads to the fact that the spring force and furthermore also the spring characteristic thus can be varied. Reference numeral 148 designates the spring characteristic without adjustment, and reference numeral 149 designates the spring characteristic upon adjustment of the pivot point of the housing 141.

Figure 9:
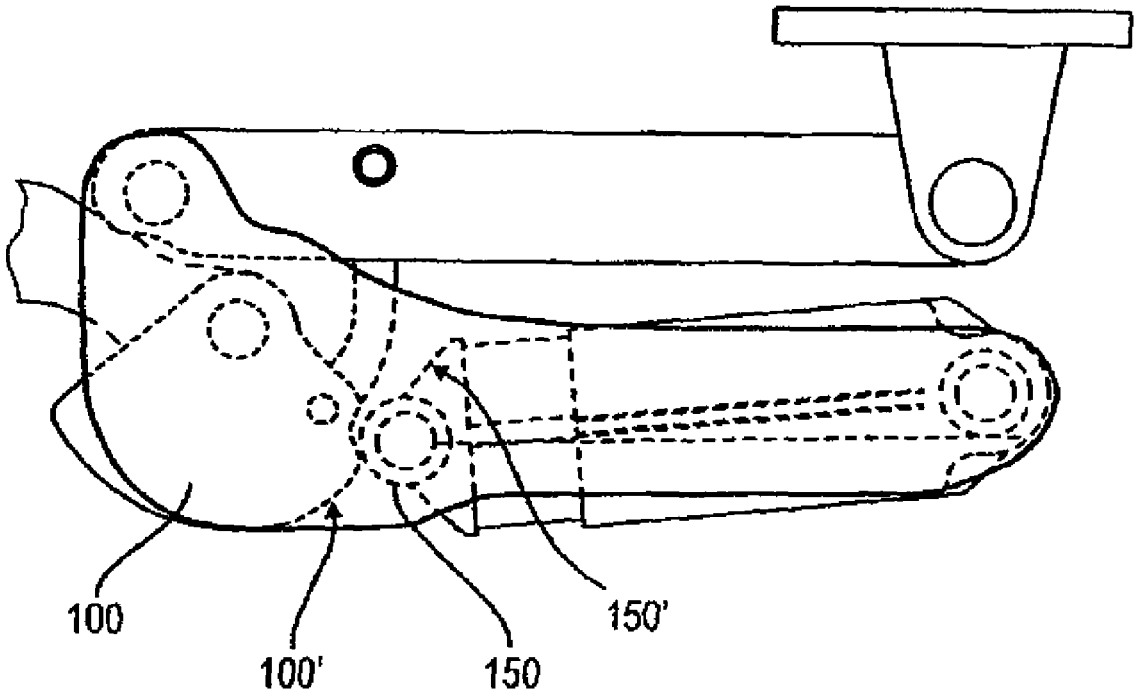

A change in the door closing characteristic also can be effected in that the eccentric path, i.e. the surface of the eccentric 100, is influenced in conjunction with a likewise changed cam path, as can be taken from FIG. 9. In this Figure, reference numeral 100' designates the eccentric path, and reference numeral 150' designates the cam path.

Figure 10:
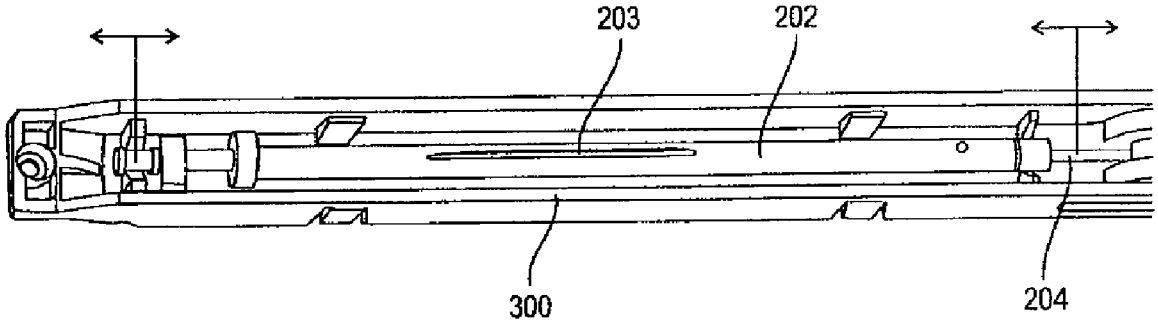
FIG. 10: shows a perspective view of the damper accommodated in the carrier with possibilities for varying the damping characteristic in accordance with the first embodiment of the invention.

FIG. 10 illustrates that by shifting the cylinder 202 of the damper 200 relative to the piston rod 204 and thus also relative to the piston, a substantial change of the damping behavior can be effected. There is effected a change in position of the overflow passages 203 relative to the piston connected with the piston rod. As can be taken from FIG. 10, this relative movement can be effected either via a continuous adjustability of the cylinder 202, i.e. of the pivotal attachment of the damper, as is indicated by the double arrow shown on the left, or on the part of the piston rod via a change in the relative position of the pivotal attachment of the piston rod, as is indicated by the double arrow shown on the right.

A change in the damping characteristic can of course also be realized by replacing the damper 200.

Figure 11:
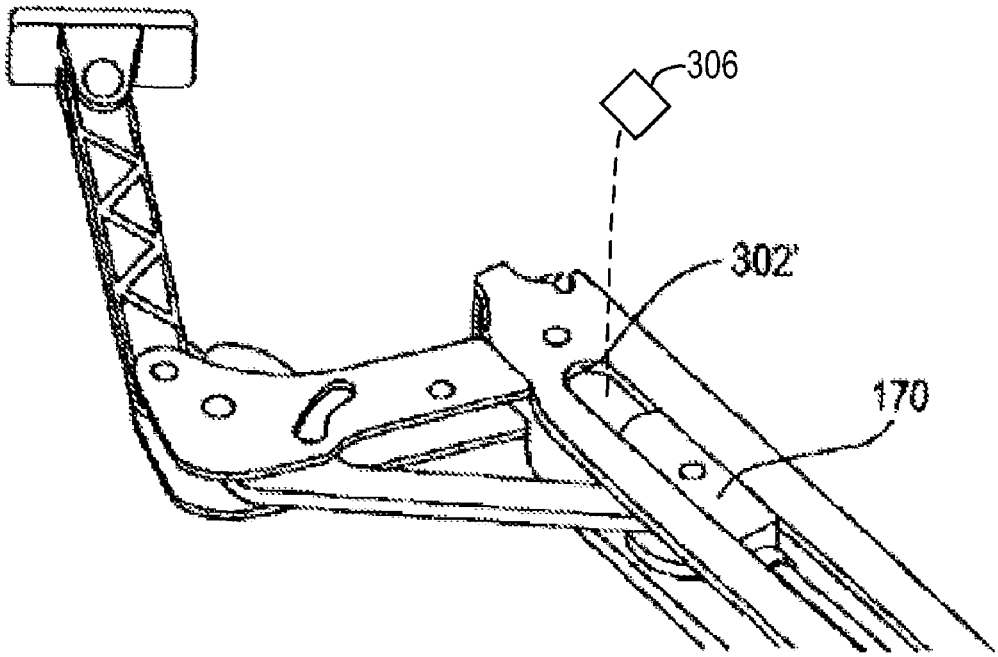
FIGS. 11, 12: show further detailed representations of the hinge in accordance with the first embodiment of the invention.

FIG. 11 finally illustrates that the limitation of the damper stroke is effected by the sliding piece(s) 170 abutting against the groove end 302'. By inserting one or more spacers 306 into the groove 302 of the carrier 300, the free groove length can be varied in a simple way. In this way, it is possible to produce a desired limited intermediate door opening position. It is also conceivable to continuously produce this limitation of the sliding carrier path via corresponding mechanisms, such as a tension cable.

Figure 12:
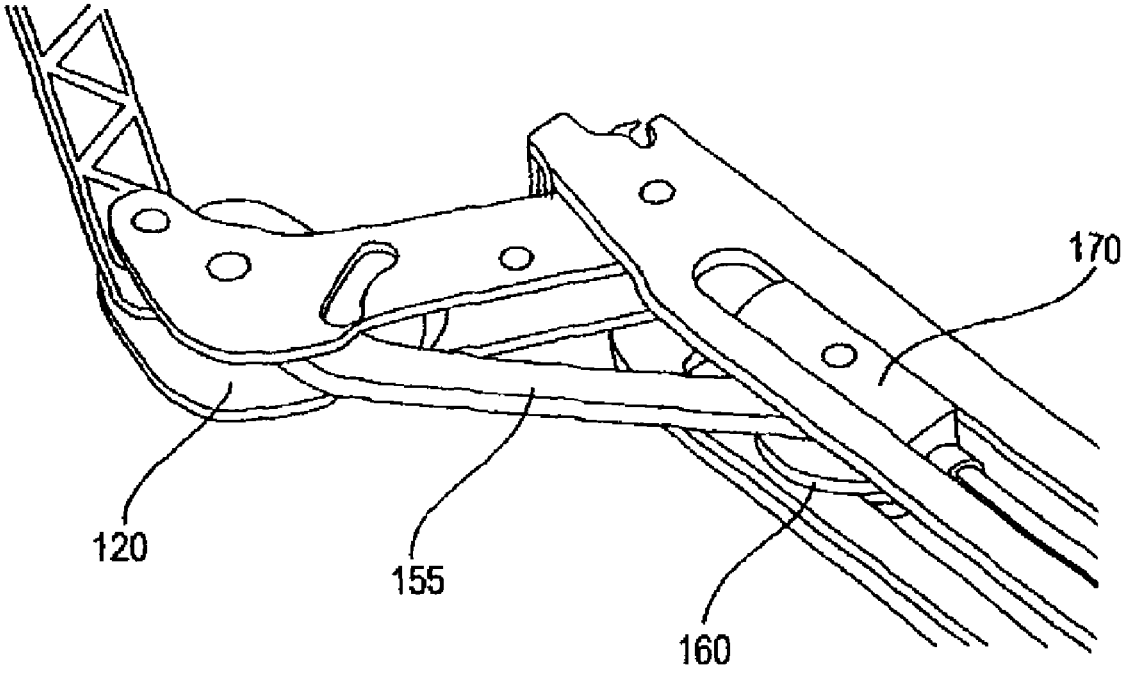

Another aspect of the invention is indicated in FIG. 12. Here, a damper lever 155 is shown, which, as explained above, connects the roller 160 or the sliding piece 170 with the hinge lever 120. This damping characteristic is based on the fact that the damper 200 never gets out of engagement over the complete door opening angle. This provides the advantage that unpleasant shock phenomena, which are desirable neither for the user nor for the material, definitely are avoided. However, it is also conceivable to couple the damper lever 155 in and out of the sliding carrier 170 in a defined range of door opening angles. In this way, shortening of the required damper path can be achieved. To avoid possible shocks, this uncoupled condition should lie in an opening range which anyway takes place with only little damping.

The invention claimed is

1. A refrigerator and/or freezer appliance with a door or flap for closing an appliance interior, comprising:

a hinge by means of which the door or flap can be swiveled relative to a body of the appliance, the hinge comprising a first means for producing a closing force acting in a closing direction of the door or flap, the first means including an eccentric and a second means which exerts a force that acts on the eccentric, the force dependent on an opening angle of the door or flap; and a damper which at least over a part of a closing movement of the door or flap applies a force directed against the closing movement of the door or flap.

2. The refrigerator and/or freezer according to claim 1, wherein the eccentric includes a surface, and that the second means which produces the force acting on the eccentric is configured and arranged such that the second means exerts a compressive force on the surface of the eccentric.

3. The refrigerator and/or freezer according to claim 2, wherein the hinge includes a first hinge lever and a second hinge lever, one of which is pivotally connected with the door or flap and the other one is pivotally connected with the body of the appliance, wherein the first and second hinge levers swivel relative to each other about a pivot point, and wherein either the eccentric is pivotally arranged on one of the first and second hinge levers and the second means is pivotally arranged on the other of the first and second hinge levers or both the eccentric and the second means are arranged on one of the first and second hinge levers.

4. The refrigerator and/or freezer according to claim 1, wherein the hinge includes a first hinge lever and a second hinge lever, one of which is pivotally connected with the door or flap and the other one is pivotally connected with the body of the appliance, and the hinge furthermore includes a tension lever which is pivotally arranged on the eccentric and on one of the hinge levers, wherein an axis on which the tension lever is pivotally attached to the eccentric does not coincide with an axis of rotation of the eccentric.

5. The refrigerator and/or freezer according to claim 4, wherein the second means which produces the force acting on the eccentric includes one or more compression springs and a roller, which runs or acts on a surface of the eccentric.

6. The refrigerator and/or freezer according to claim 5, wherein the damper includes a piston moving in a cylinder and a piston rod connected with the piston, which is pivotally attached to the hinge.

7. The refrigerator and/or freezer according to claim 5, wherein the damper includes a piston moving in a cylinder and a piston rod connected with the piston, which is directly or indirectly acted upon by a damper lever pivotally connected with the hinge.

8. The refrigerator and/or freezer according to claim 7, wherein the damper is arranged and configured such that independent of an opening angle of the door or flap it extends at least approximately parallel to a plane formed by the door or flap or to a plane formed by a front side of the body.

9. The refrigerator and/or freezer according to claim 8, wherein one or more rollers are provided, which are arranged on the damper lever and which are configured such that they absorb forces acting transverse to the piston rod of the damper at least when the door or flap is closed.

10. The refrigerator and/or freezer according to claim 9, wherein one or more sliding elements are arranged on the damper lever, which are guided in one or more grooves of a carrier.

11. The refrigerator and/or freezer according to claim 10, wherein one or more spacers are provided for varying a damper stroke, the spacers arranged to vary a length of the grooves.

12. The refrigerator and/or freezer according to claim 11, wherein the damper lever is releasable from the piston rod.

13. The refrigerator and/or freezer according to claim 1, wherein the hinge includes a connecting link guide in which the second means are guided.

14. The refrigerator and/or freezer according to claim 13, wherein the hinge includes a first lever and a second lever, one of which is pivotally connected with the door or flap and the other one is pivotally connected with the body of the appliance, and the connecting link guide is arranged in one of the levers.

15. The refrigerator and/or freezer according to claim 1, wherein the second means which exerts the force acting on the eccentric is pivotally arranged about a pivot point, which is variable in its position.

16. The refrigerator and/or freezer according to claim 15, wherein the pivot point variable in its position is formed by an eccentric bolt.

17. The refrigerator and/or freezer according to claim 1, wherein the damper includes a piston moving in a cylinder and a piston rod connected with the piston, and a pivotal attachment of the cylinder to a carrier and/or a pivotal attachment of the piston rod to the hinge is variable in its position.

18. The refrigerator and/or freezer according to claim 1, wherein a carrier is provided, in which the damper is arranged, wherein the damper is connected with the carrier by a latching connection.

19. The refrigerator and/or freezer according to claim 1, wherein a module is provided, which includes a carrier, in or on which the damper and the hinge are arranged and which is inserted into the door or flap or into the body of the appliance as a unit.

20. The refrigerator and/or freezer according to claim 19, wherein the hinge and the damper and the module are arranged outside a cooled region of the appliance.

21. The refrigerator and/or freezer according to claim 19, wherein the damper and the module are arranged in a side of the door facing the body or in a side of the body facing the door.

22. The refrigerator and/or freezer according to claim 19, wherein the damper and the module are arranged substantially parallel to a plane formed by the door or substantially parallel to a plane formed by a front side of the body.

23. The refrigerator and/or freezer according to claim 22, wherein the module is connected with the door or with the body of the appliance by a positive connection including a latching connection and/or a screw connection.

24. A refrigerator and/or freezer appliance with a door or flap for closing an appliance interior, with a hinge, by means of which the door or flap can be swivelled relative to a body of the appliance, wherein the hinge includes means for producing a closing force acting in a closing direction of the door or flap, and with a damper which at least over a part of a closing movement of the door or flap applies a force directed against the closing movement of the door or flap, wherein the means for producing the closing force includes a tension cable, which is connected with the hinge and with one or more tension springs.

25. The refrigerator and/or freezer according to claim 24, wherein the damper includes a piston moving in a cylinder and a piston rod connected with the piston, which is pivotally attached to the hinge.

26. A refrigerator and/or freezer appliance with a door or flap for closing an appliance interior, comprising:

a hinge by means of which the door or flap can be swivelled relative to a body of the appliance, the hinge comprising a first means for producing a closing force acting in a closing direction of the door or flap, the first means including an eccentric and a second means which exerts a force that acts on the eccentric, the force dependent on an opening angle of the door or flap;

a damper which at least over a part of a closing movement of the door or flap applies a force directed against the closing movement of the door or flap; and a module, including a carrier, in or on which the damper and the hinge are arranged;

wherein the module is inserted into the door or flap or into the body of the appliance as a unit.

* * * * *